US009125447B2

(12) United States Patent
Lebel et al.

(10) Patent No.: US 9,125,447 B2
(45) Date of Patent: Sep. 8, 2015

(54) HELMET ATTACHMENT MECHANISM FOR VISOR

(75) Inventors: Stéphane Lebel, Saint-Rédempteur (CA); Martin Bélanger, Québec (CA)

(73) Assignee: Revision Military S.a.r.L., Luxembourg (LU)

( * ) Notice: Subject to any disclaimer, the term of this patent is extended or adjusted under 35 U.S.C. 154(b) by 745 days.

(21) Appl. No.: 13/236,993

(22) Filed: Sep. 20, 2011

(65) Prior Publication Data

US 2012/0090079 A1 Apr. 19, 2012

Related U.S. Application Data

(60) Provisional application No. 61/384,389, filed on Sep. 20, 2010.

(51) Int. Cl.
*A42B 3/18* (2006.01)

(52) U.S. Cl.
CPC ..... *A42B 3/185* (2013.01)

(58) Field of Classification Search
CPC ..... A42B 3/185
USPC ..... 2/5, 6.5, 10, 411, 422, 424
See application file for complete search history.

(56) References Cited

U.S. PATENT DOCUMENTS

| | | | | |
|---|---|---|---|---|
| 2,860,343 A | | 11/1958 | Aileo | |
| 3,400,407 A | * | 9/1968 | Aileo | 2/6.5 |
| 3,409,909 A | * | 11/1968 | Donald et al. | 2/432 |
| 3,833,935 A | | 9/1974 | Ansite et al. | |
| 4,150,464 A | | 4/1979 | Tracy | |
| 4,536,892 A | | 8/1985 | Brinkhoff et al. | |
| 4,713,844 A | * | 12/1987 | Westgate | 2/411 |
| 4,734,940 A | * | 4/1988 | Galet et al. | 2/422 |
| 4,912,950 A | | 4/1990 | Crowle | |
| 5,012,528 A | | 5/1991 | Pernicka et al. | |

(Continued)

FOREIGN PATENT DOCUMENTS

| | | |
|---|---|---|
| CA | 520 480 A | 1/1956 |
| CA | 1 034 701 A | 7/1978 |

(Continued)

OTHER PUBLICATIONS

International Search Report for International Application No. PCT/CA2011/050579 mailed Nov. 2, 2011.

(Continued)

*Primary Examiner* — Richale Quinn
(74) *Attorney, Agent, or Firm* — Wolf, Greenfield & Sacks, P.C.

(57) ABSTRACT

An assembly for mounting a visor on a helmet includes a visor assembly having a lens and a fastening element with a pair of latching prongs each with a resiliently displaceable prong end; a casing attached to the helmet and having a pair of channels each for receiving the a latching prong and a pair of fixtures, each fixture for engaging a respective prong end when displaced outwardly; and a lock having a pair of locking prongs, each locking prong being insertable into one channel from an opposite end as the latching prongs and each locking prong having a locking prong end that is positionable under a respective latching prong to prevent displacement of the latching prong end inwardly to disengage from the respective fixture.

18 Claims, 29 Drawing Sheets

(56) References Cited

U.S. PATENT DOCUMENTS

| | | | | |
|---|---|---|---|---|
| 5,144,725 | A | 9/1992 | Krauss | |
| 5,182,816 | A | 2/1993 | Arai | |
| 5,291,880 | A | 3/1994 | Almovist et al. | |
| 5,311,649 | A | 5/1994 | Suh | |
| 5,327,619 | A | 7/1994 | Ortega | |
| 5,329,642 | A * | 7/1994 | Dampney | 2/424 |
| 5,373,583 | A * | 12/1994 | Birum | 2/10 |
| 5,419,020 | A | 5/1995 | Murai | |
| 5,604,930 | A | 2/1997 | Petit et al. | |
| 5,890,233 | A * | 4/1999 | Kaffka | 2/424 |
| 5,901,369 | A | 5/1999 | Pilney | |
| 5,966,738 | A * | 10/1999 | Wang Lee | 2/10 |
| 5,987,652 | A * | 11/1999 | Fowler | 2/424 |
| 6,389,606 | B1 * | 5/2002 | Galet et al. | 2/410 |
| 6,560,830 | B1 | 5/2003 | Chi | |
| 6,820,285 | B2 * | 11/2004 | Bataille et al. | 2/422 |
| 6,931,695 | B2 | 8/2005 | Anscher | |
| 7,150,082 | B2 | 12/2006 | Beletsky | |
| 7,219,406 | B2 | 5/2007 | Chui | |
| D574,558 | S * | 8/2008 | Morency et al. | D29/122 |
| 7,540,033 | B2 * | 6/2009 | Kim et al. | 2/6.7 |
| 7,631,365 | B1 * | 12/2009 | Mahan | 2/6.7 |
| 7,805,776 | B2 * | 10/2010 | Crossman et al. | 2/424 |
| 7,900,268 | B2 * | 3/2011 | Mahan | 2/6.5 |
| 8,225,419 | B2 * | 7/2012 | Hersick et al. | 2/5 |
| 8,286,270 | B2 * | 10/2012 | Higgins | 2/422 |
| 8,458,822 | B2 * | 6/2013 | Lee | 2/424 |
| 8,539,613 | B2 * | 9/2013 | Hersick et al. | 2/5 |
| 2007/0083967 | A1 * | 4/2007 | Crossman et al. | 2/15 |
| 2009/0144872 | A1 * | 6/2009 | Lebel et al. | 2/6.7 |
| 2012/0278963 | A1 * | 11/2012 | Hersick et al. | 2/5 |

FOREIGN PATENT DOCUMENTS

| | | | |
|---|---|---|---|
| CA | 1 122 351 | A | 4/1982 |
| CA | 2593037 | | 7/1987 |
| CA | 2 048 028 | C | 2/1992 |
| CA | 2 037 753 | C | 4/1992 |
| CA | 2 053 069 | A1 | 4/1992 |
| CA | 2 043 448 | A1 | 8/1992 |
| CA | 2 158 620 | A1 | 3/1996 |
| CA | 2 289 371 | A1 | 5/2000 |
| CA | 2 509 169 | A1 | 12/2006 |
| CA | 2 512 827 | A1 | 10/2007 |
| CA | 2 520 480 | A1 | 10/2007 |
| EM | 001202428-0002 | | 4/2010 |
| WO | WO 2008/043170 | A1 | 4/2008 |

OTHER PUBLICATIONS

International Preliminary Report on Patentability for International Application No. PCT/CA2011/050579 mailed Apr. 4, 2013.

* cited by examiner

HELMET ATTACHMENT MECHANISM FOR VISOR

This application claims the benefit of U.S. Provisional Application Ser. No. 61/384,389, filed Sep. 20, 2010.

TECHNICAL FIELD OF THE INVENTION

The present invention relates to visors for use with helmets, and particularly for a visor and a mechanism for mounting the visor to the helmet to allow controlled actuation of the visor between deployed and stowed positions.

BACKGROUND OF THE INVENTION

Visors for use in military and law-enforcement helmets are known such as disclosed in U.S. Pat. Nos. 5,901,369 and 4,536,892. These visors provide pivot arrangements on opposite lateral sides of the visor to allow the visor to be pivoted upward away from the user's face when the visor is not deployed. The visor is held in a deployed position in front of the user's face by locking of the pivot arrangements.

This headgear typically takes the form of a helmet having a hard outer shell formed of a synthetic composite material, and an inner foamed polymer lining. The hard outer shell withstands shock loads, while the resiliency of the foamed lining evenly dissipates the forces of the shock load over a wider area. This interaction between the outer shell and liner helps to protect the helmet wearer against head injury, such as a concussion. A visor or face shield is typically attached to the helmet to cover at least a portion of a helmet front opening. The visor protects the face and eyes of the wearer. A mounting mechanism attaches the visor to the helmet to permit raising and lowering of the visor between in use or deployed position and stowed position.

Protective headgear comprising a helmet and a visor which is mounted via a mechanism to permit visor movement between stowed and use positions are generally known. For example, U.S. Pat. Nos. 5,901,369; 5,604,930; 5,182,816; 5,012,528; 3,833,935; and 2,860,343 all describe helmet and visor assemblies.

The present inventors have recognized that there is a need for improved protective headgear for soldiers. In particular, present inventors have recognized there is a need for headgear having a mounting mechanism for a visor that allows a soldier to quickly and easily move the visor between deployed and stowed positions and also to quickly and easily remove the visor from the helmet for replacement or cleaning.

SUMMARY OF THE INVENTION

The present invention provides a helmet adapted for fitting upon a wearer's head, a visor and a mechanism for mounting the visor to the helmet. The helmet has a forward facing front opening that permits forward viewing by the wearer. The mounting mechanism allows the visor to be moved between a deployed position wherein the visor covers the front opening to protect the wearer's face and eyes, and a stowed position wherein the visor is completely clear of the front opening so as to not obstruct the forward view of the wearer.

The mounting mechanism includes a visor with a lens and a fastening element with a latching prong with a resiliently displaceable prong end, a casing attached to the helmet and having a channel for receiving the latching prong and a fixture for engaging the prong end when displaced outwardly, and a lock having a locking prong that is insertable into the channel from an opposite end as the latching prong and which has a locking prong end that is positionable under the latching prong to prevent displacement of the latching prong end inwardly to disengage from the fixture.

The casing can be pivotally and slidably attached to the helmet.

The lock can be spring biased in the casing to the locked position.

The lock can include a locking detent that is releasably engaged to the casing to hold the lock in the locked position.

The casing can be mounted onto a mounting assembly having an arcuate guide slot. The casing can have a lug that rides in the guide slot as the visor is raised from a deployed position to a tilted-up position.

The casing can be pivotally fastened to a lever that is pivotally fastened to the mounting assembly.

The mounting assembly can include a bracket having hooks that engage a brim of the helmet, a strap that attaches to the bracket, and a guide plate fastened to the bracket. The guide plate can provide the arcuate guide slot. An elastic cord can be fixed to the guide plate at one end and to the casing at an opposite end, the elastic cord channeled along a top of the guide plate.

The mounting assembly can also be pivotally fastened to the helmet.

The latching element can comprise a pair of prongs and the fixture in the casing can comprise edge portions of the casing that define opposite side windows. The latching prongs can be deflected inwardly to enter parallel channels and, when fully inserted, spring outwardly such that the latching prong ends enter the windows with the edges preventing outward retraction of the latching prongs from the casing. The locking prongs can be inserted into the locked position underlying the respective latching prongs in the parallel channels, preventing inward movement of the latching prongs.

The mounting mechanism of the headgear allows a wearer of the helmet to quickly and easily move the visor between deployed and stowed positions or remove the visor from the helmet. In addition, the visor in its stowed position does not obstruct the helmet wearer's line of sight or otherwise interfere with the wearer's forward view through the helmet's front opening. Moreover, the components of the headgear are relatively easy and inexpensive to manufacture.

Numerous other advantages and features of the present invention will be become readily apparent from the following detailed description of the invention and the embodiments thereof, from the claims and from the accompanying drawings.

DETAILED DESCRIPTION

Figure 1:
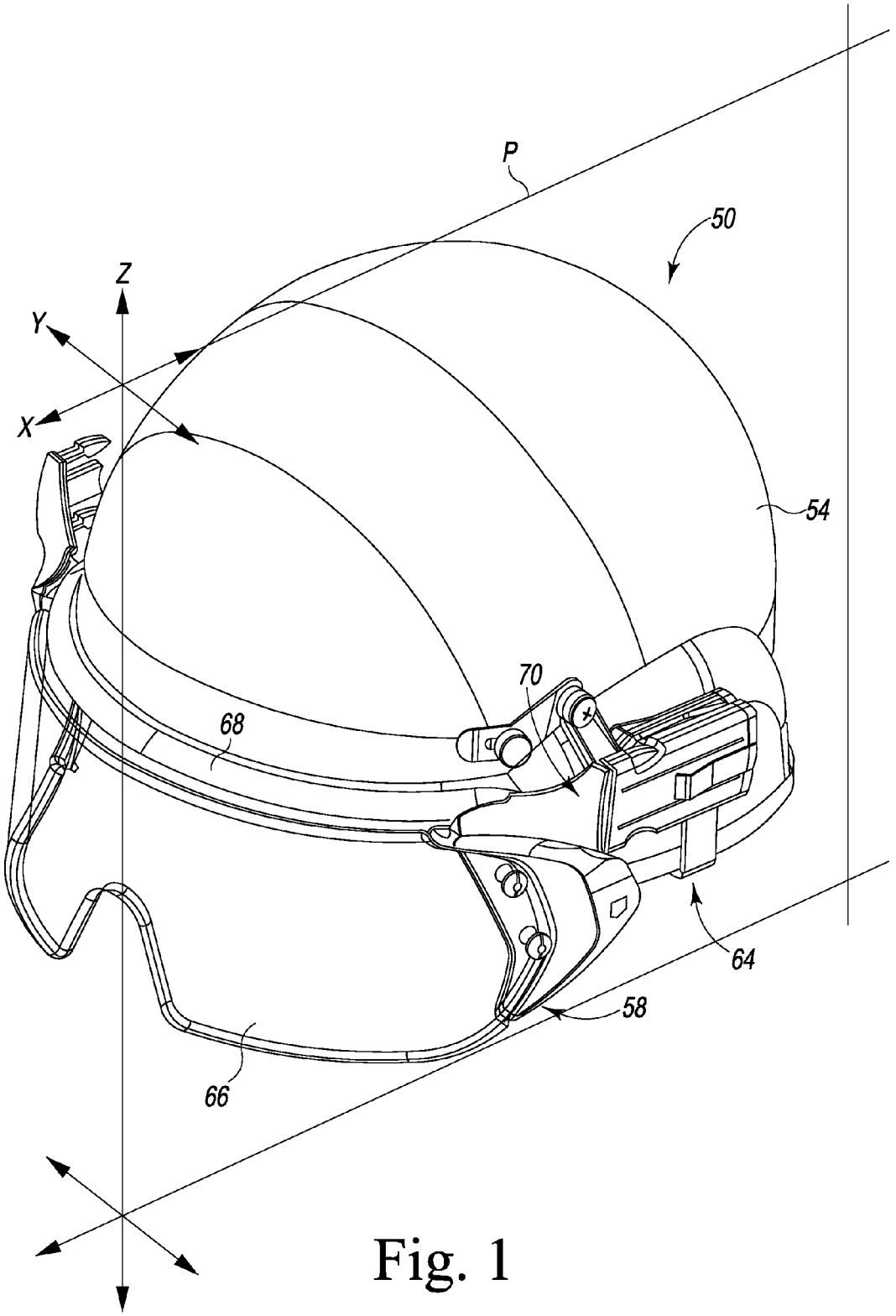
FIG. 1 is a perspective view of a helmet assembly according to one embodiment of the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates a helmet assembly 50 that includes a helmet 54, a visor assembly 58 and two visor connection assemblies 64, one on each lateral side of the helmet. The visor assembly 58 can be as described in U.S. patent application Ser. No. 11/811,361, filed Jun. 9, 2007, herein incorporated by reference. The visor assembly 58 includes a lens 66, a brow sealing element 68, and latching connectors 70, one located on each lateral side of the visor assembly 58. The latching connectors 70 and visor connection assemblies 64 are mirror image identical across a center plane P of the helmet assembly 50, center plane P being vertical and centered substantially between the eyes and ears of the wearer. Thus, it is only necessary to describe the left hand (from the perspective of one wearing the helmet) latching connectors 70 and visor connection assembly 64 in that the right hand latching connectors 70 and visor connection assembly 64 are mirror image identical.

Figure 2:
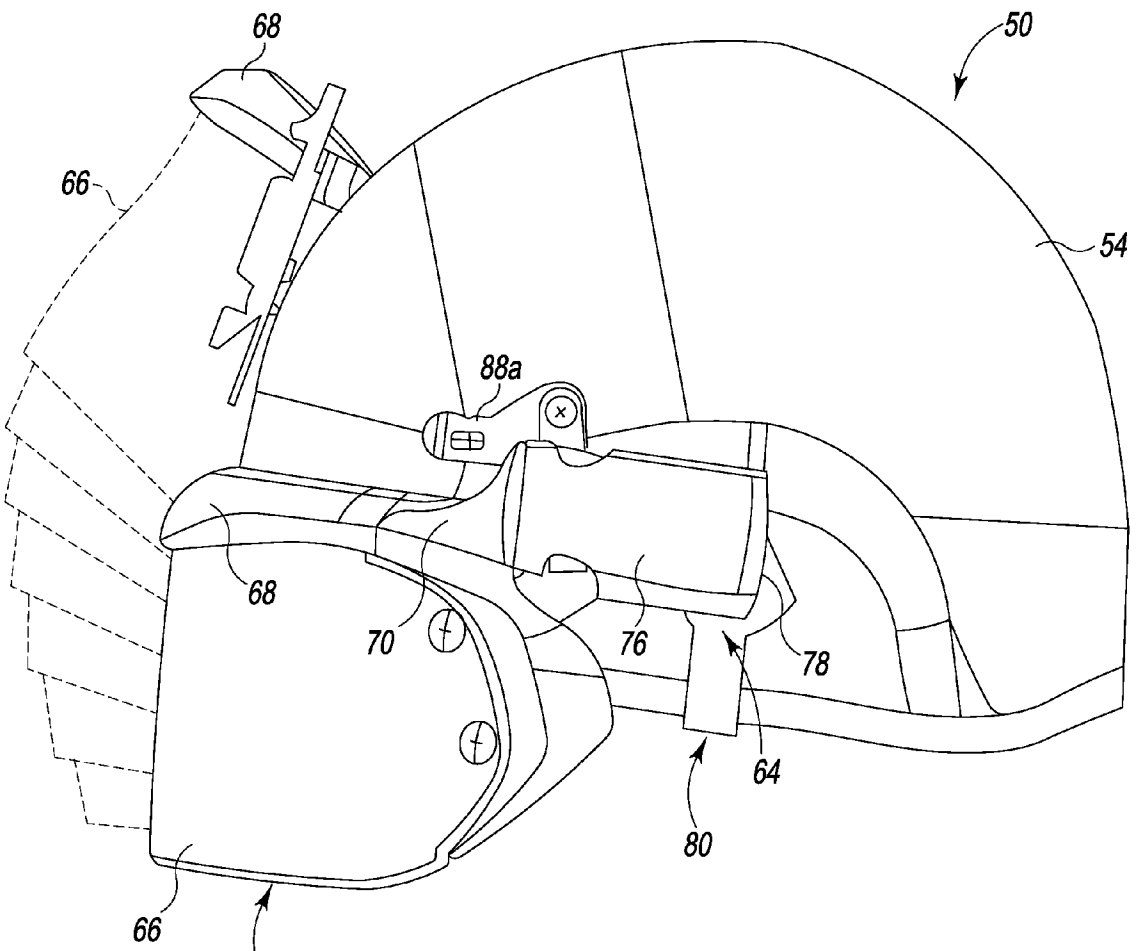
FIG. 2 is a schematic side view of the helmet assembly of FIG. 1 showing a visor in a deployed position.

FIG. 2 illustrates the visor assembly 58 both in a lowered, deployed position and in an alternate tilted up position.

Figure 3:
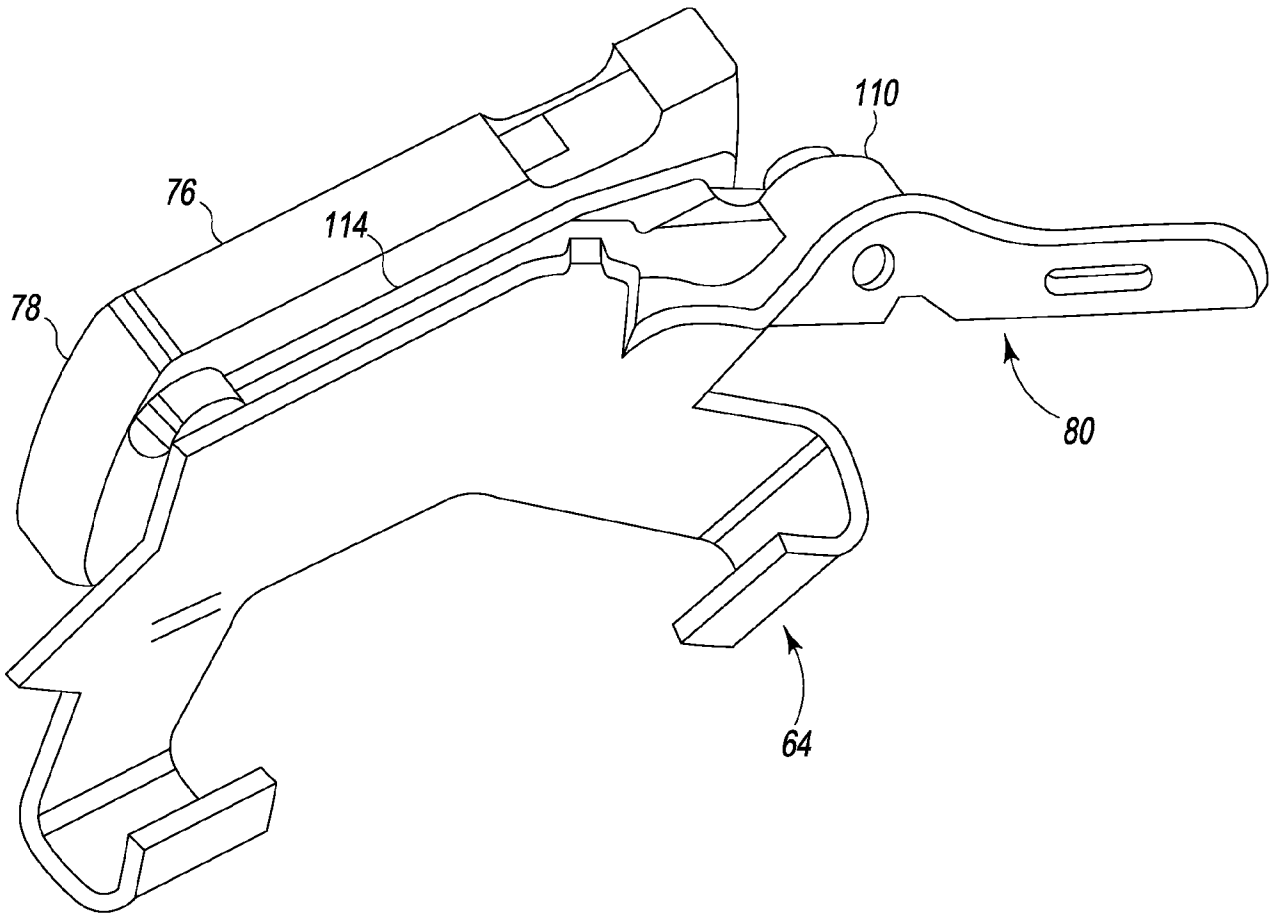
FIG. 3 is a perspective view of a portion of the helmet assembly of FIG. 2.

FIGS. 2 and 3 illustrate the connection assembly 64 includes a latch casing 76 a lock element 78, and a helmet engaging assembly 80.

Figure 4:
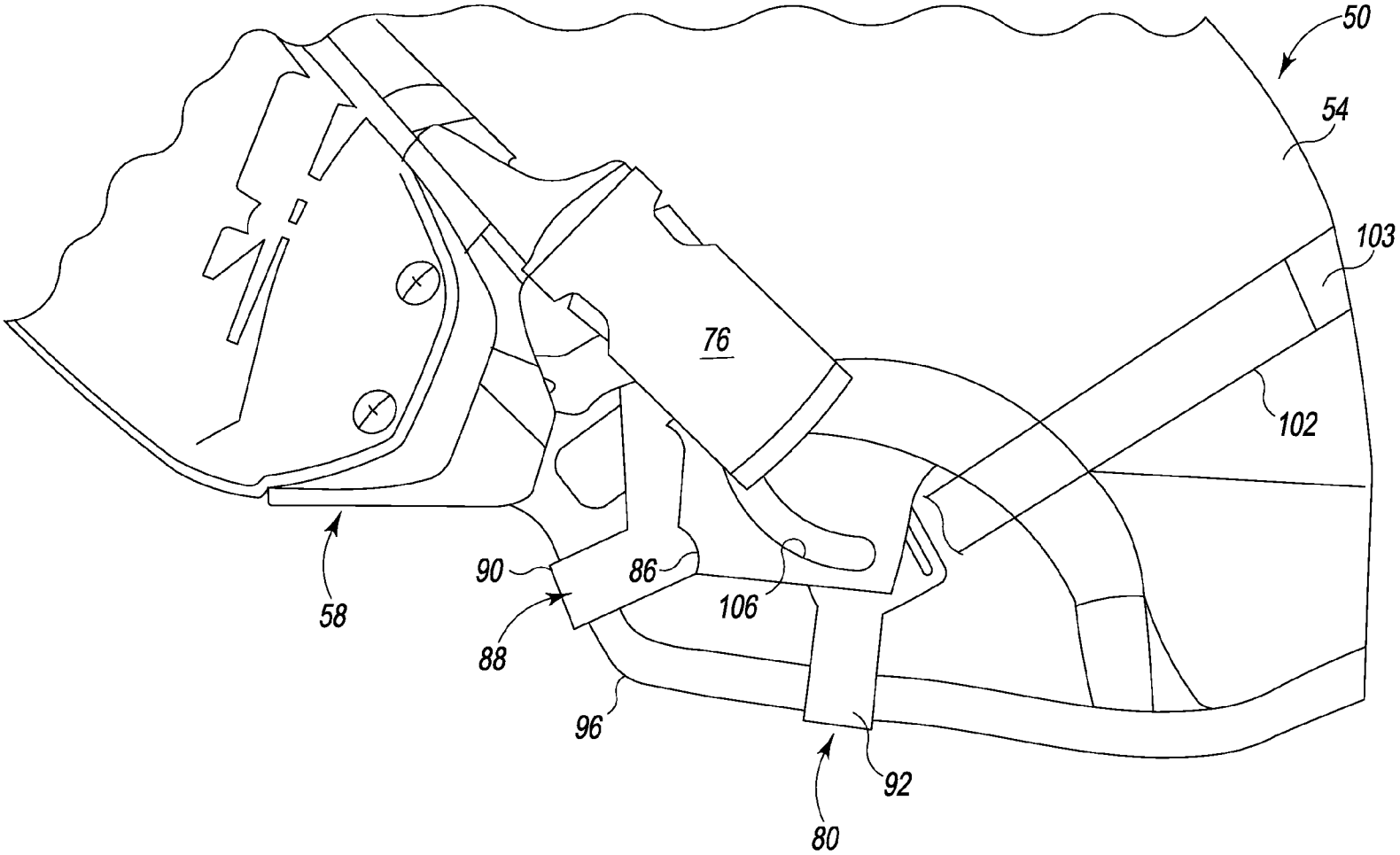
FIG. 4 is a fragmentary schematic side view of the helmet assembly shown in FIG. 2, showing the visor in a tilted up position.

FIG. 4 illustrates the helmet assembly 50 with the visor assembly 58 in a tilted up position. The helmet engaging assembly 80 includes a guide plate 86 preferably a polymer material, mounted on a bracket 88, preferably a metallic material, such as steel. Bracket 88 includes upper and lower engaging hooks 90, 92 which engage a bottom rim or bottom edge 96 of the helmet 54. The bracket 88 includes a strap slot 100 which receives a strap 102 which wraps a back surface of the helmet 54 and connects left and right brackets 88 together to hold both brackets 88 snugly onto the helmet 54. The strap can include a length adjustment element and/or an attachment buckle 103. The guide plate 86 includes a slot 106 which guides movement of the casing 76 when the visor is moved from the downward deployed position to the tilted-up position.

Figure 5:
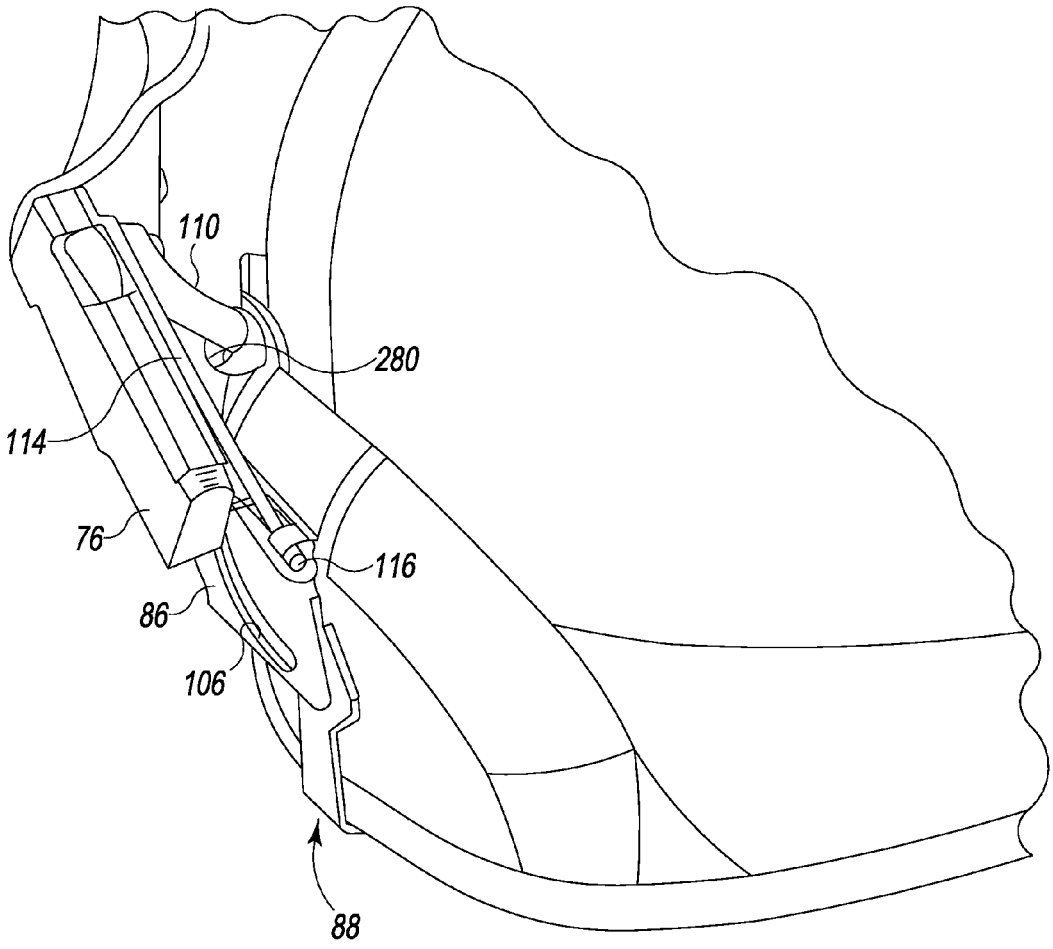
FIG. 5 is a fragmentary schematic rear perspective view of the helmet assembly of FIG. 4.
Figure 6:
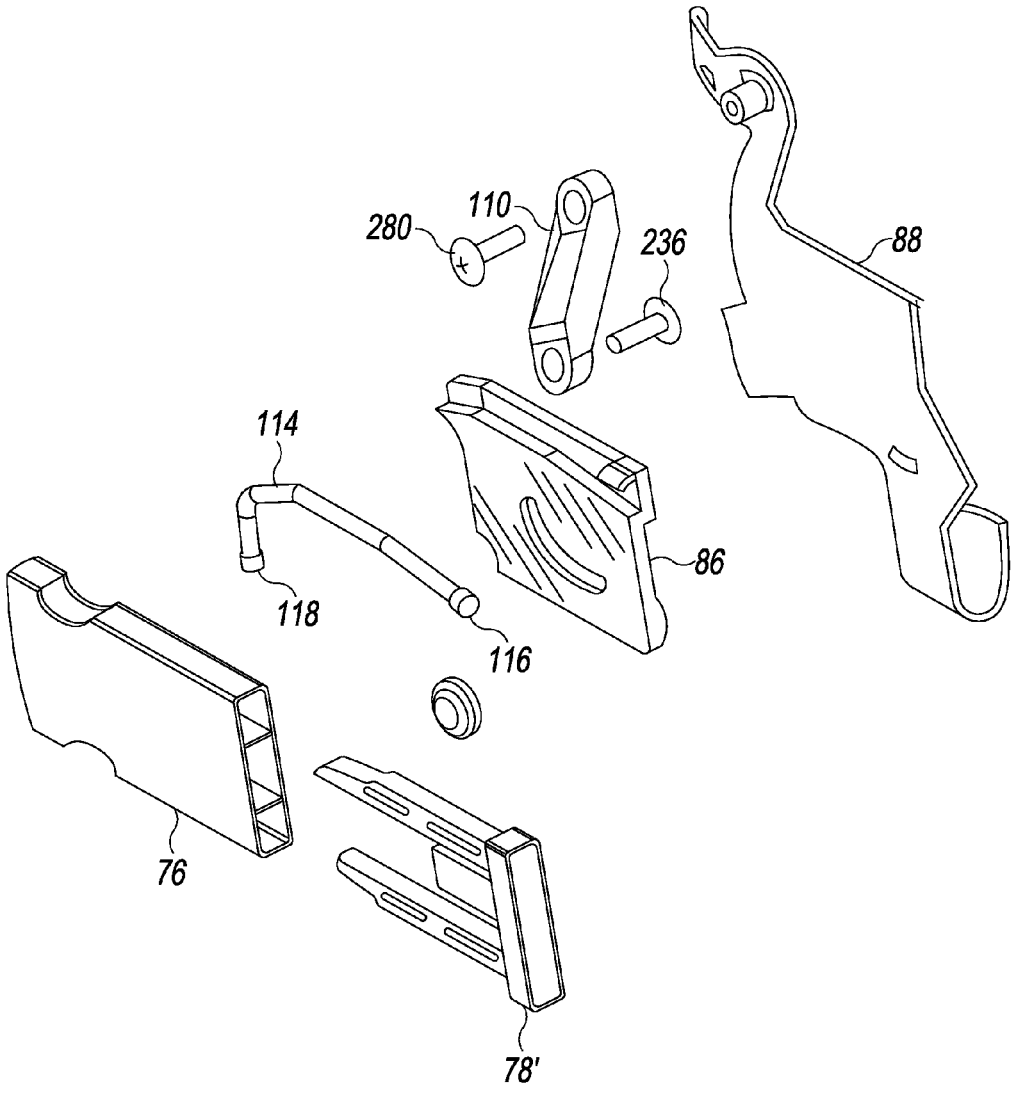
FIG. 6 is an exploded perspective view of a portion of the helmet assembly of FIG. 2.

FIG. 5 illustrates the casing 76 in the tilted up position. FIGS. 5 and 6 illustrate a lever arm 110 being pivotally connected between the casing 76 and the bracket 88. An elastic cord 114 having end anchors or heads 116, 118, resiliently retains the visor in the tilted up position. The elastic cord 114 is fixed at the anchor 116 to the back plate 86 and at the anchor 118 to the casing 76 (shown in FIG. 18).

Figure 7:
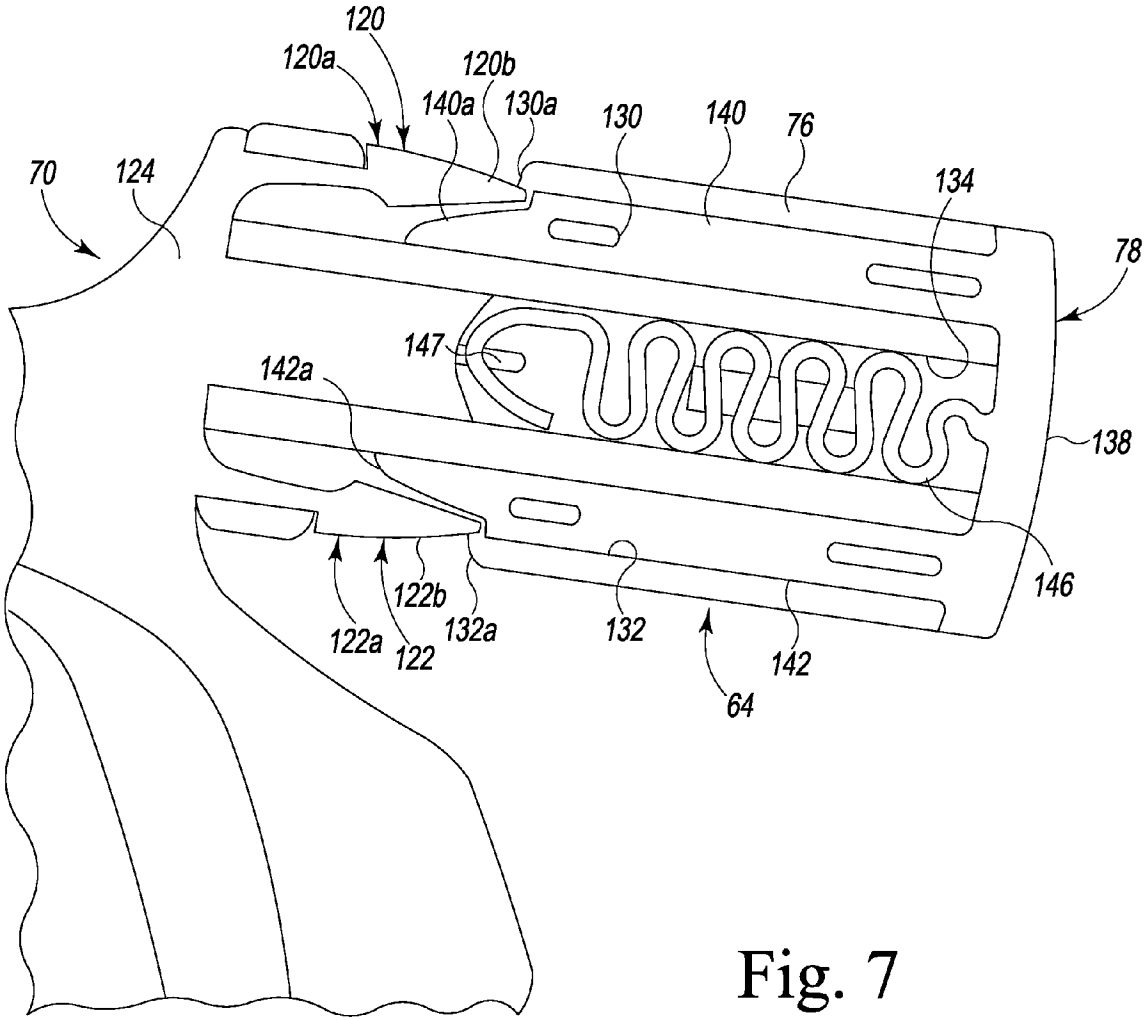
FIG. 7 is a fragmentary schematic view of a portion of the helmet assembly of FIG. 2, showing the visor in a locked condition.

FIG. 7 illustrates the visor latching connectors 70 latched and locked to the visor connection assembly 64. The latching connector 70 includes upper and lower prongs 120, 122, with prong hooks 120*a*, 122*a*, and a center plug 124. The prongs 120, 122 are resiliently flexible toward and away from each other. The casing 76 includes upper and lower prong through channels 130, 132 having upper and lower windows 130*a*, 132*a*, and a central through channel 134. To connect the latching connector 70 to the casing 76, the upper and lower prongs 120, 122 are resiliently urged toward each other by insertion pressure on inclined planes 120*b*, 122*b* on the prong hooks 120*a*, 122*a* from a user during insertion into the prong through channels 130, 132 until prong hooks 120*a*, 122*a* resiliently rebound away from each other and into the windows 130*a*, 132*a*.

At the same time the plug 124 snuggly fits into the central channel 134. The connectors 70 cannot be retracted from the casing 76 due to the presence of the hooks 120*a*, 122*a* in the windows 130*a*, 132*a* unless the hooks 120*a*, 122*a* are deflected toward each other to clear the windows 130*a*, 132*a* to be slid back out through the prong channels 130, 132.

In FIG. 7 the lock 78 prevents the hooks 120*a*, 122*a* from being deflected toward each other to clear the windows 130*a*, 132*a*. The lock 78 includes a base 138, locking prongs 140, 142, and a spring 146 extending from the base 138.

As shown in FIG. 7, the locking prongs 140, 142 are inserted into the through channels 130, 132 from an opposite direction as the latching prongs 120, 122. The locking prongs 140, 142 include tapered engagement ends 140*a*, 142*a* that wedge against, or at least underlie, the hooks 120*a*, 122*a*. By interference, the ends 140*a*, 142*a* prohibit the hooks 120*a*, 122*a* from being depressed inwardly to clear the windows 130*a*, 132*a*. The spring 146 is inserted into the central channel 134. The spring 146 has a lug 146*a* that fixes an end of the spring 146 to the casing 76 by snapping into an aperture 147 through a back wall of the casing 76. The spring 147 urges the lock 78 to the position shown in FIG. 7, the locked position.

Figure 8:
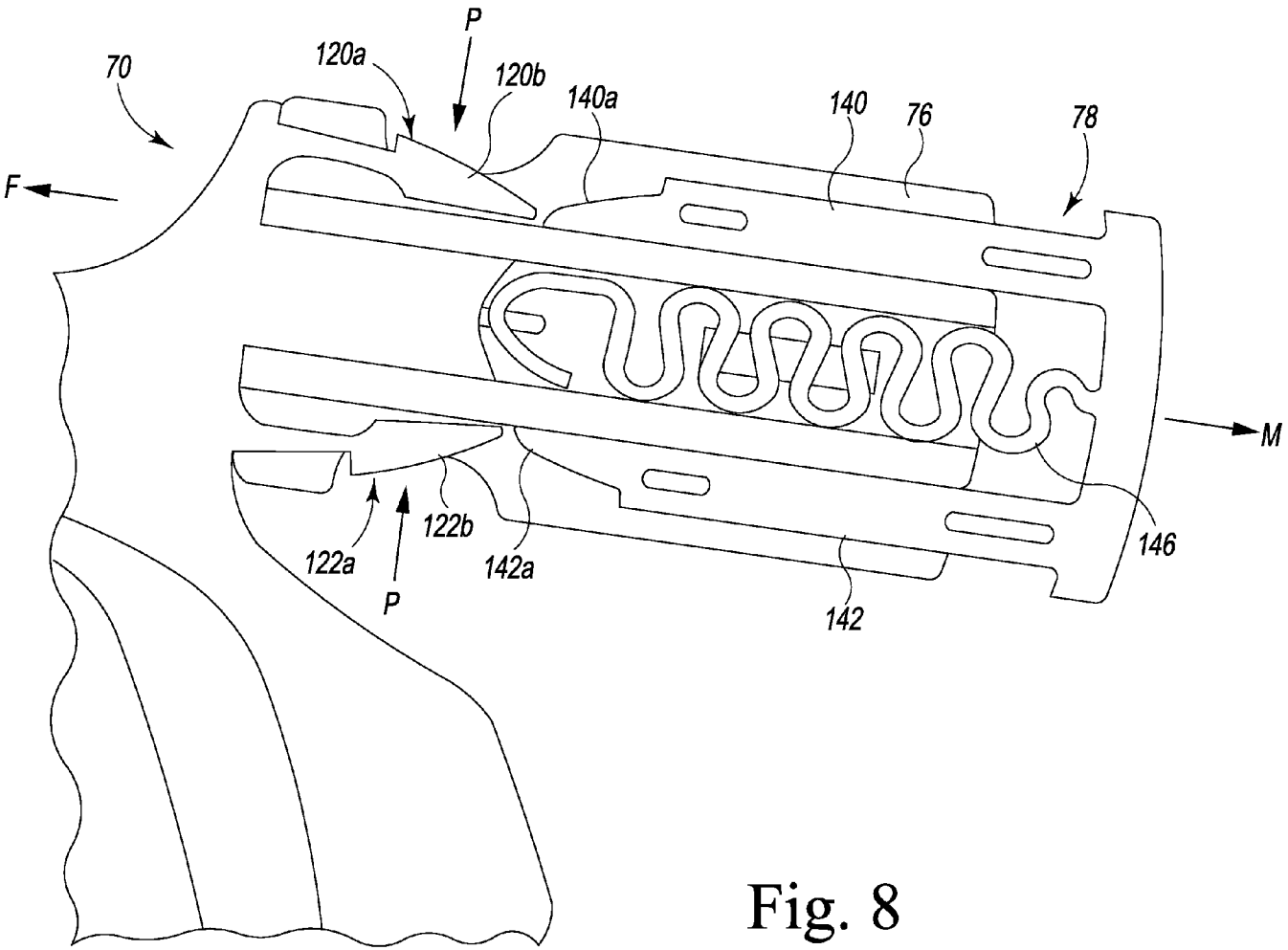
FIG. 8 is a fragmentary schematic view of the portion of the helmet assembly of FIG. 7, showing the visor in an unlocked condition.

FIG. 8 illustrates that when a user urges the lock 78 to the right with force M, and stretches the spring 146, the tapered engagement ends 140*a*, 142*a* move away from the hooks 120*a*, 122*a* so that the hooks 120*a*, 122*a* can be deflected toward each other as shown by a pinching finger pressure P. A simultaneous retraction force F on the connectors 70 will release the connectors 70 from the casing 76.

Figure 9:
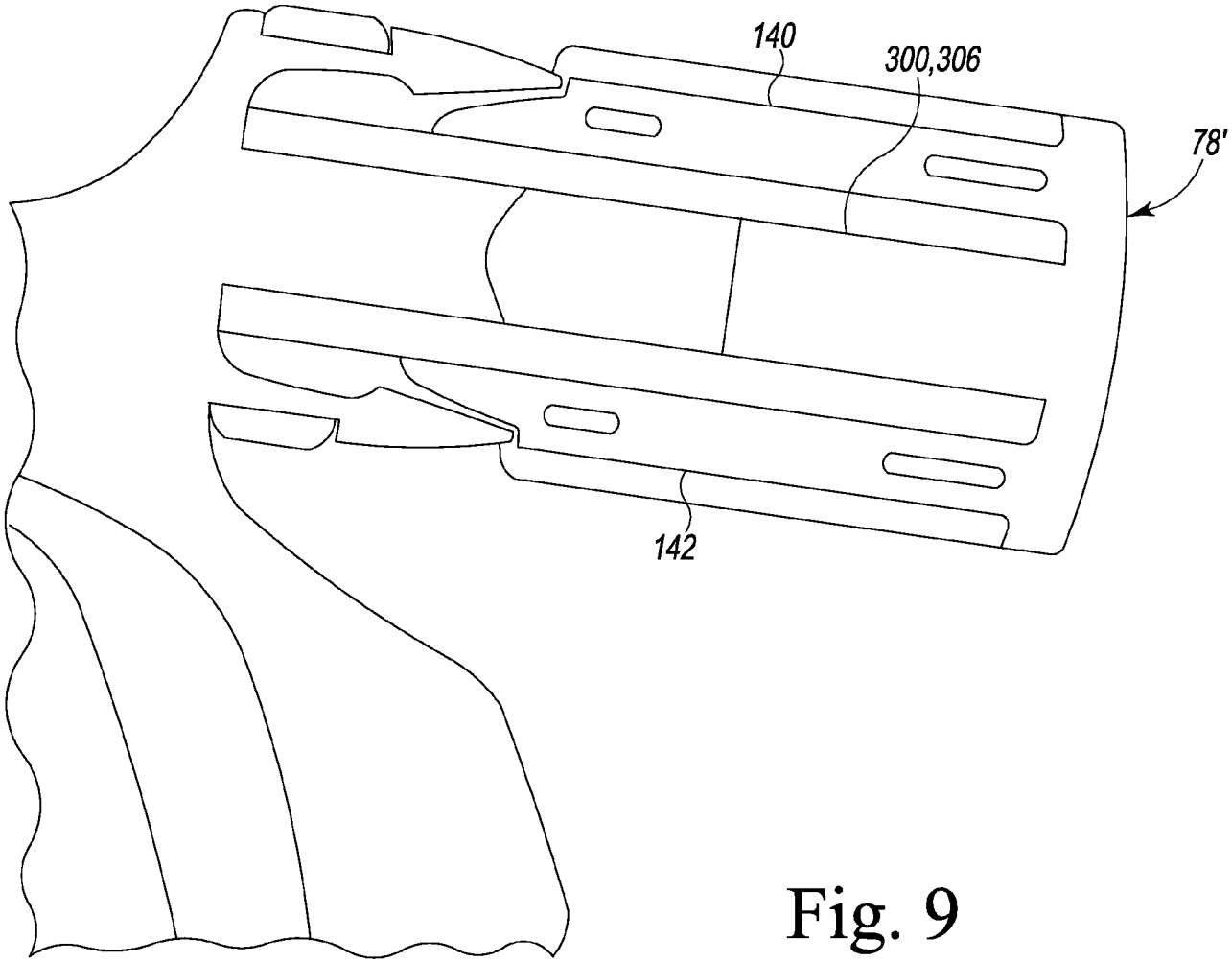
FIG. 9 is a fragmentary schematic view of an alternate embodiment portion of the helmet assembly of FIG. 2, showing the visor in a locked condition.
Figure 10:
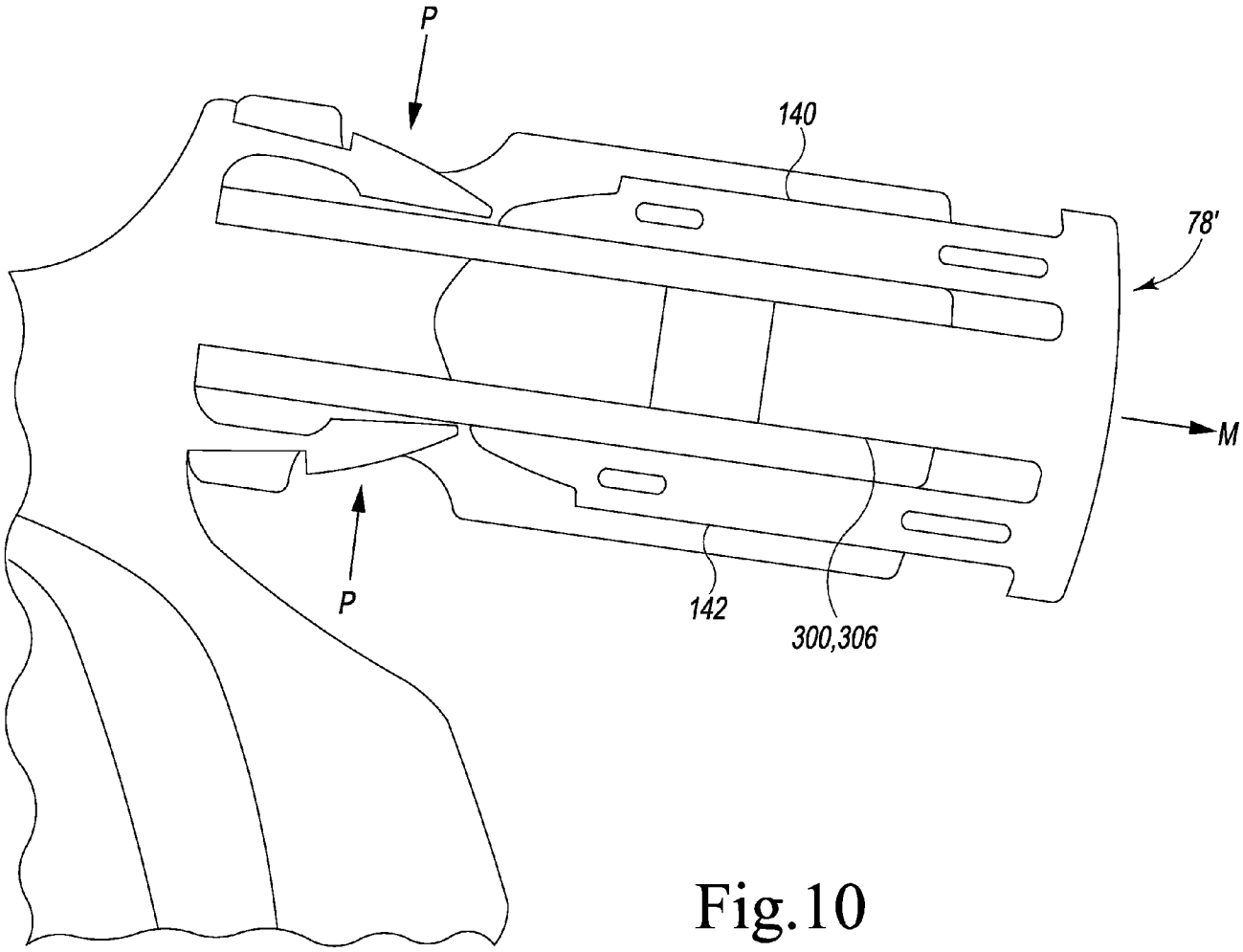
FIG. 10 is a fragmentary schematic view of the alternate embodiment portion of the helmet assembly of FIG. 9, showing the visor in an unlocked condition.
Figure 11:
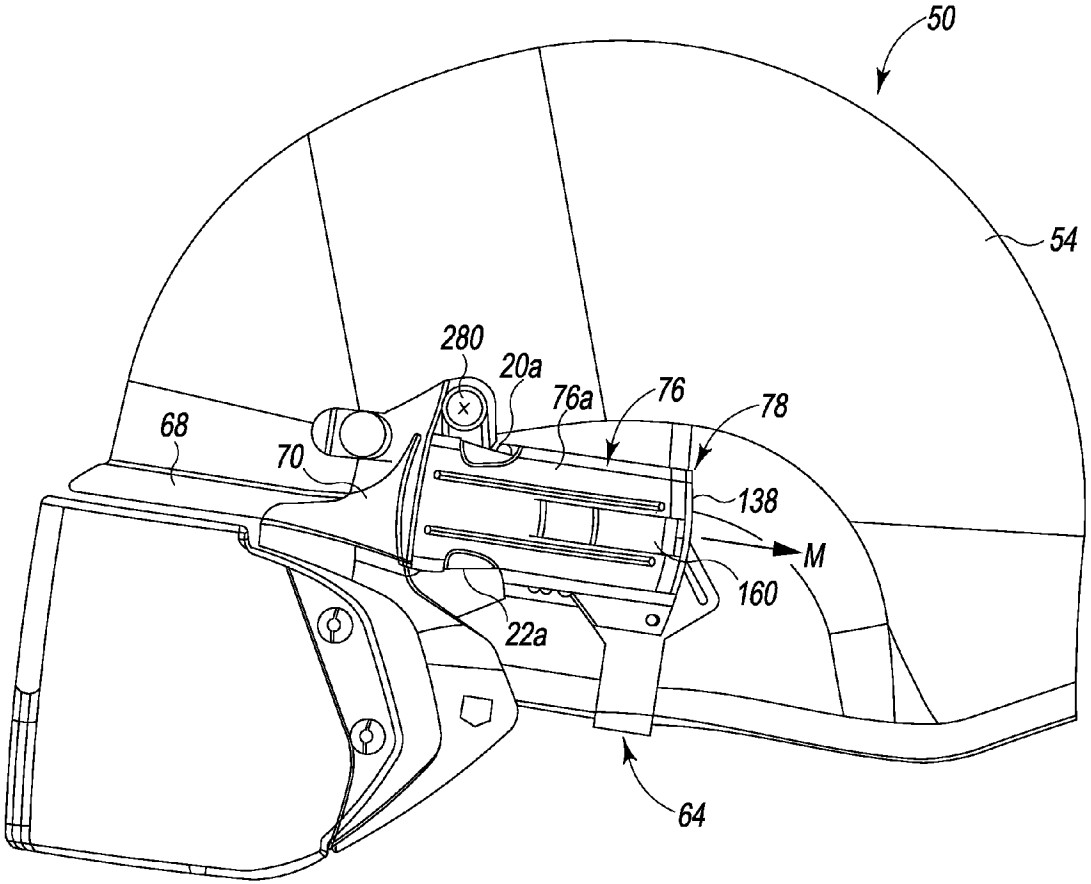
FIG. 11 is a side view of the helmet assembly of FIG. 1.
Figure 12:
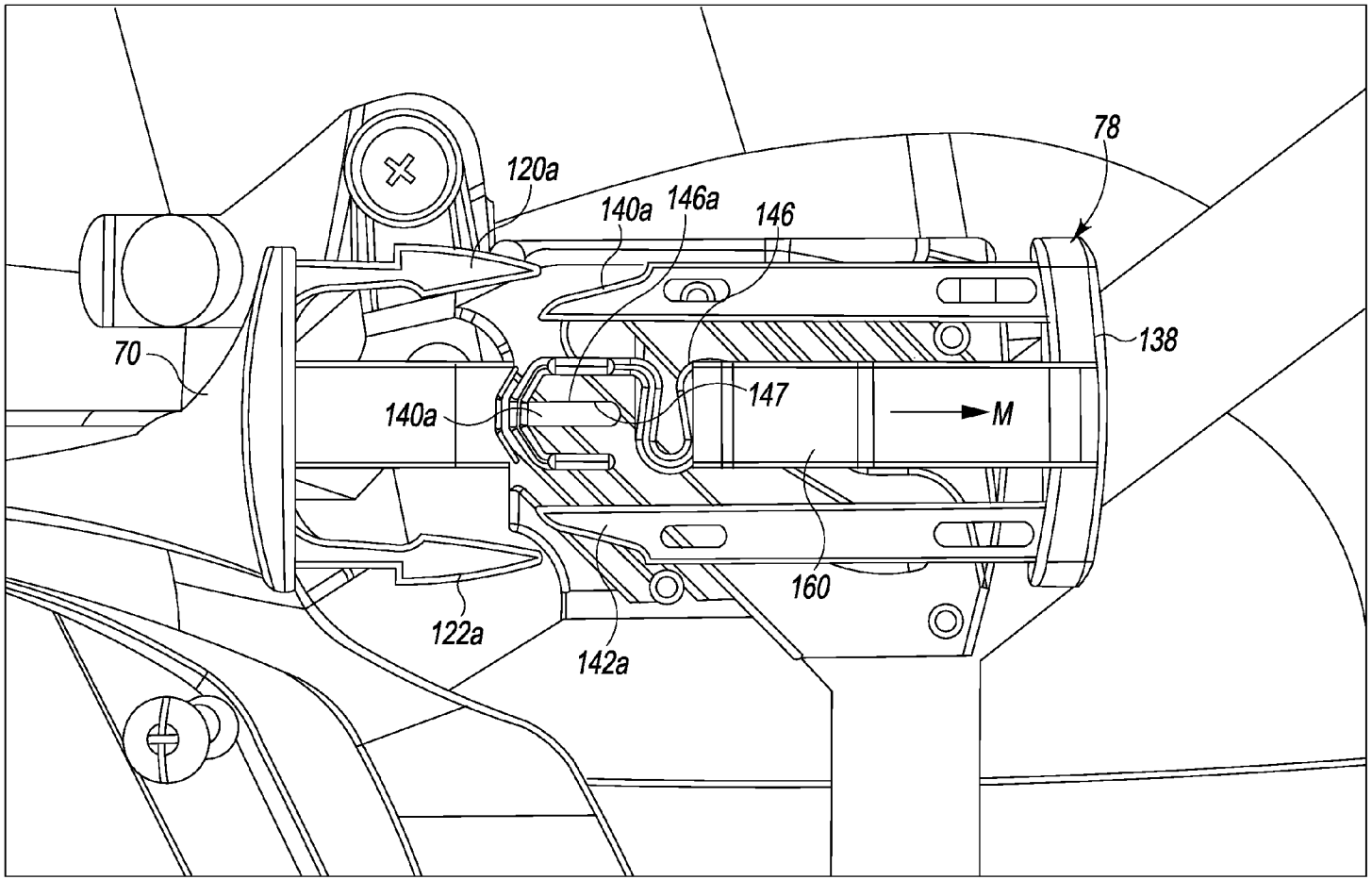
FIG. 12 is an enlarged fragmentary view of a visor connection portion of FIG. 11 with portions removed to view underlying components, shown in an unlocked but latched configuration.

FIGS. 9 and 10 illustrate an alternate embodiment lock 78' which is identical to the first embodiment except that the embodiment eliminates the spring 146, and makes the engagement of the lock 78' to the prongs 120, 122 a strictly manual operation. This embodiment is described below in more detail with regard to FIGS. 23-28.

FIGS. 11-16 illustrate the embodiment of FIGS. 7 and 8 and the interaction between the latching connectors 70, and the lock 78, with the casing 76 removed to see underlying parts. The Figures illustrate that the lock 78 includes in actuating slider 160 that extends from the base 138. The slider 160 is arranged to overlie a front wall 76*a* of the casing 76 (see FIG. 11). Thus, for a user to shift the lock 78 to the unlock position shown in FIG. 12, the slider is pushed with force in the direction M. The spring 146 is stretched and the engagement ends 140*a*, 142*a* becomes spaced from the hooks 120*a*, 122*a*.

Figure 13:
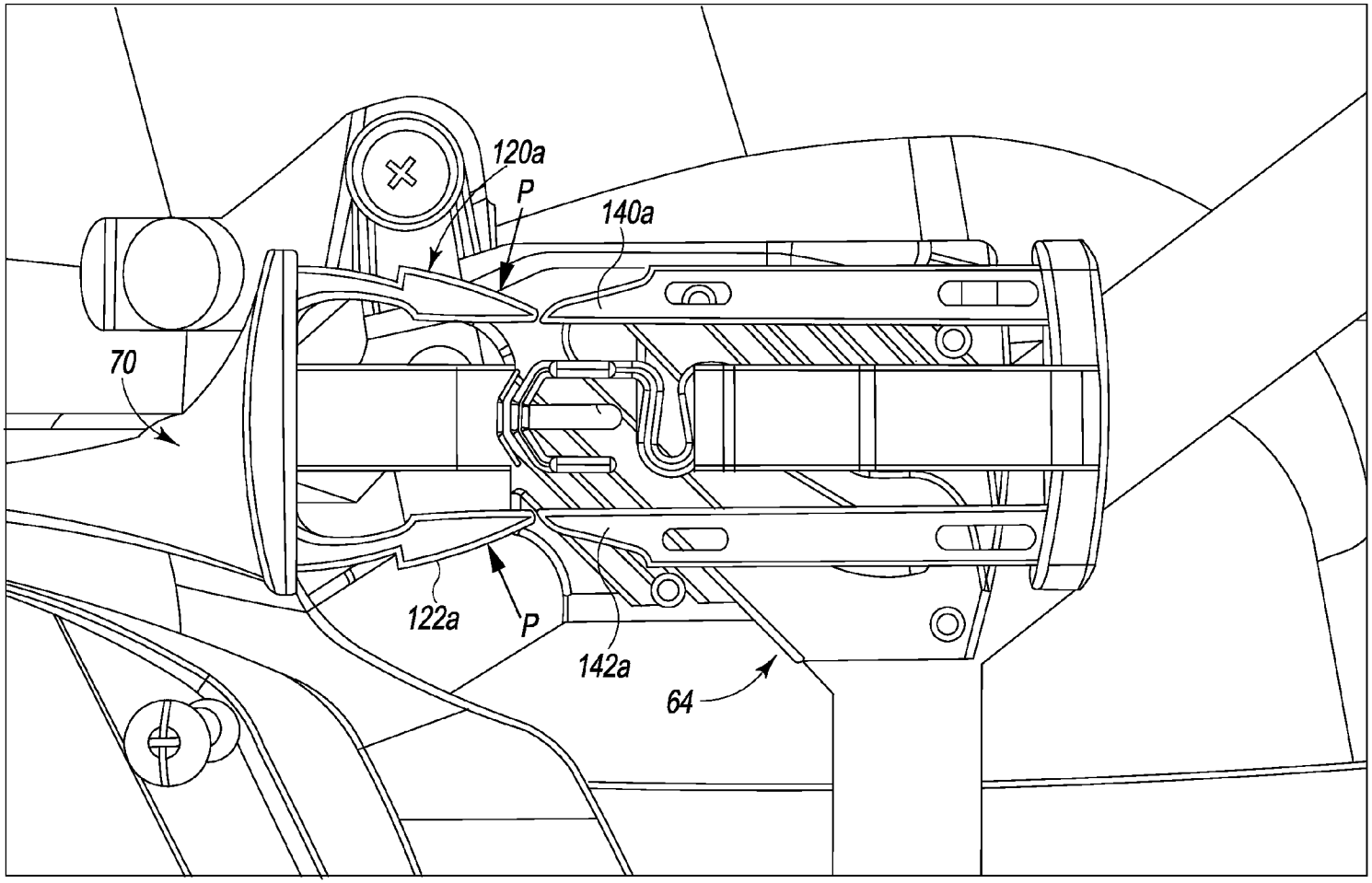
FIG. 13 is an enlarged fragmentary view of a visor connection portion of FIG. 12 with portions removed to view underlying components, shown in an unlocked and unlatched configuration.

As shown in FIG. 13, the hooks 120*a*, 122*a* are then pinched inwardly with finger pressure P to the extent necessary to retract the prongs 120, 122 from the through channels 130, 132 to be able to remove the latching connectors 70 from the connection assembly 64.

Figure 14:
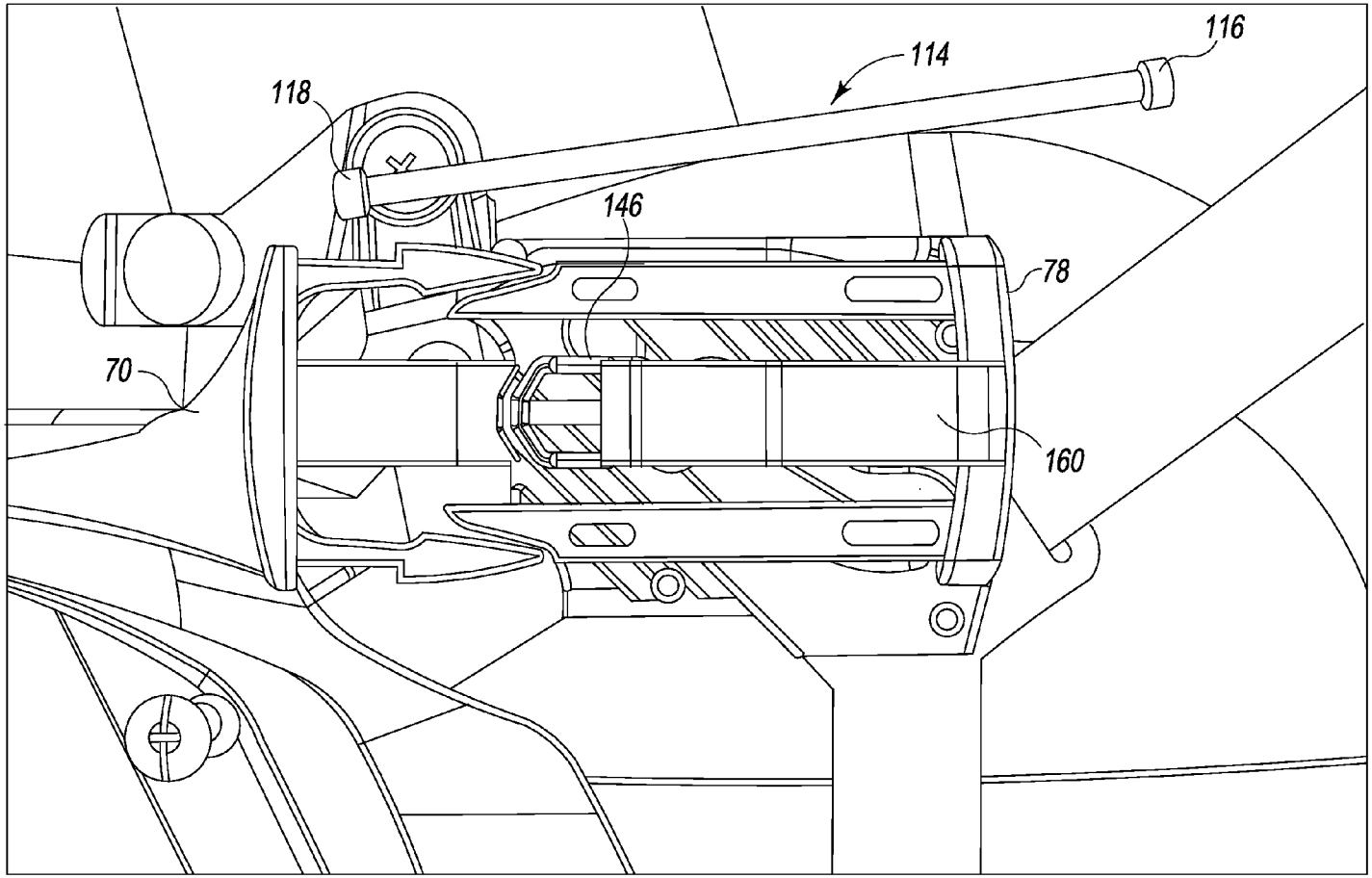
FIG. 14 is an enlarged fragmentary view of the visor connection portion of FIG. 11 with portions removed to view underlying components, shown in a latched and locked configuration.

FIG. 14 illustrates the locked condition wherein the spring 146 retains the lock 78 in a position to prevent the hooks 120*a*, 122*a* from being inwardly moved.

Figure 15:
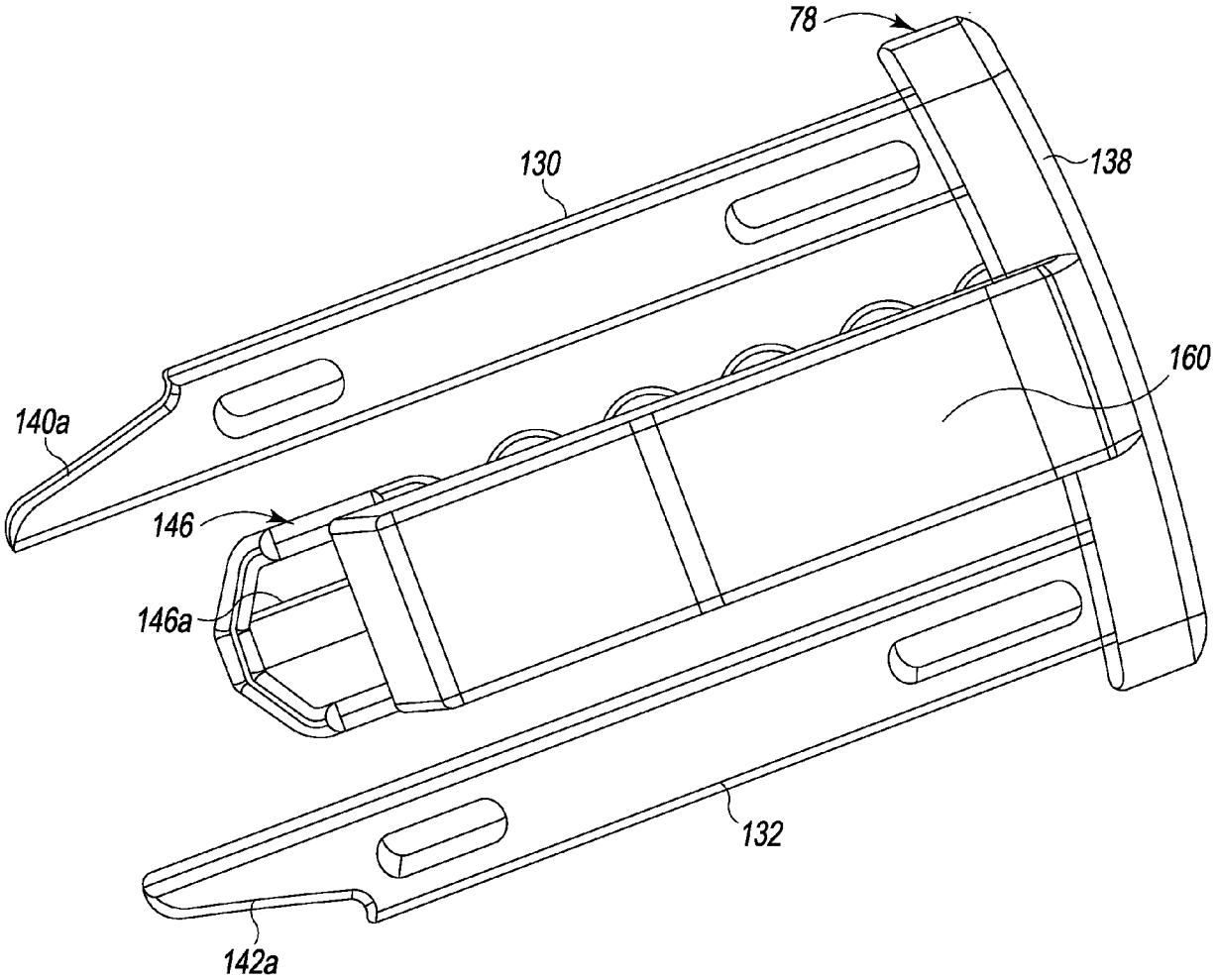
FIG. 15 is a right side perspective view of a locking element taken from FIG. 14.
Figure 16:
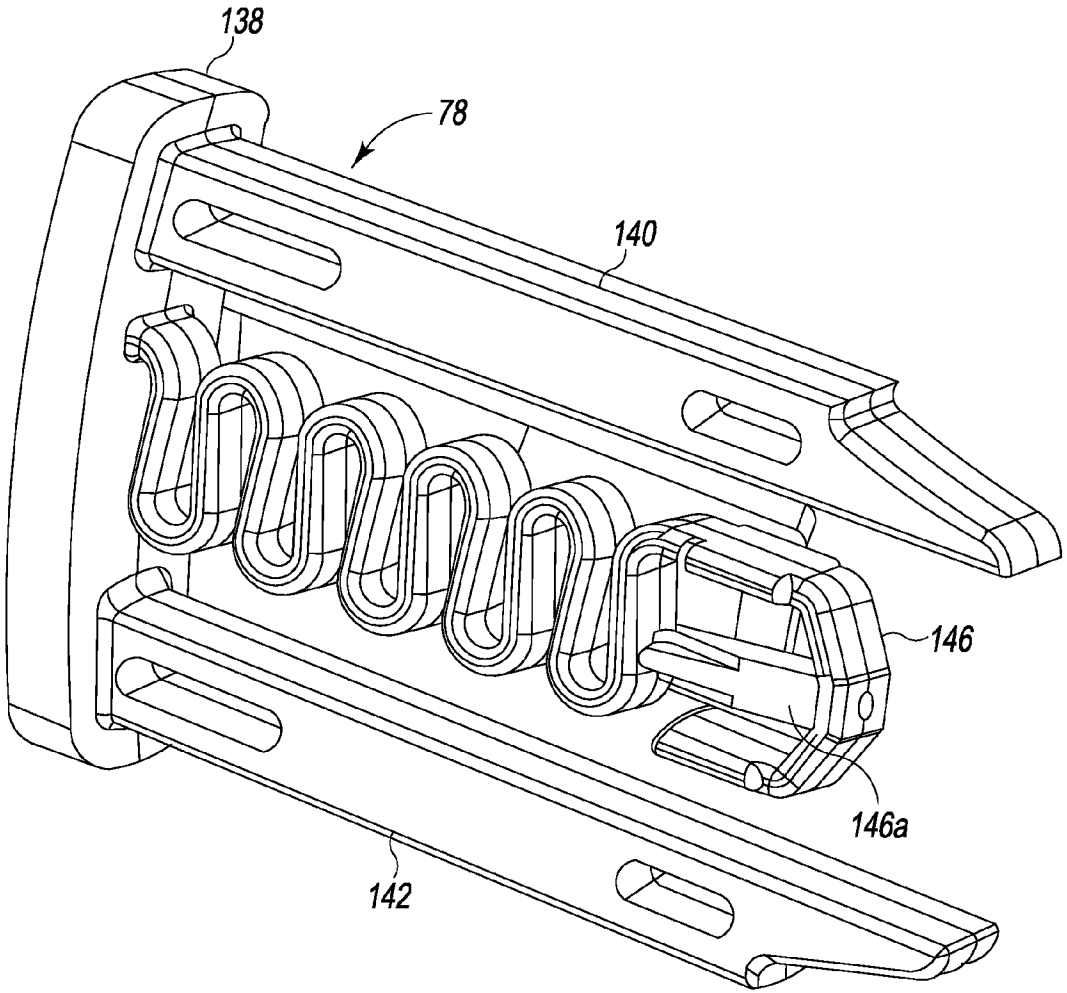
FIG. 16 is a left side perspective view of a locking element taken from FIG. 15.
Figure 16A:
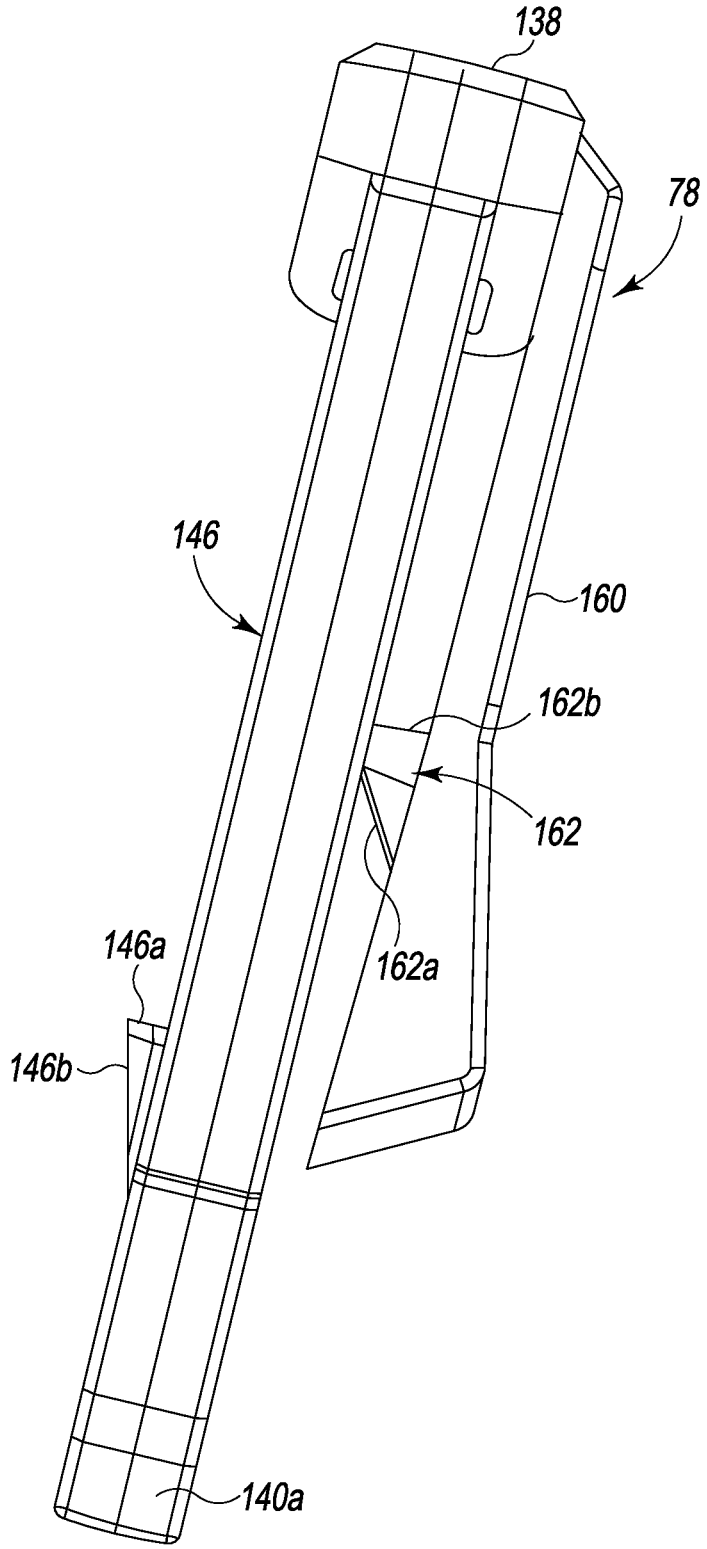
FIG. 16A is a top view of the locking element shown in FIG. 16.
Figure 17:
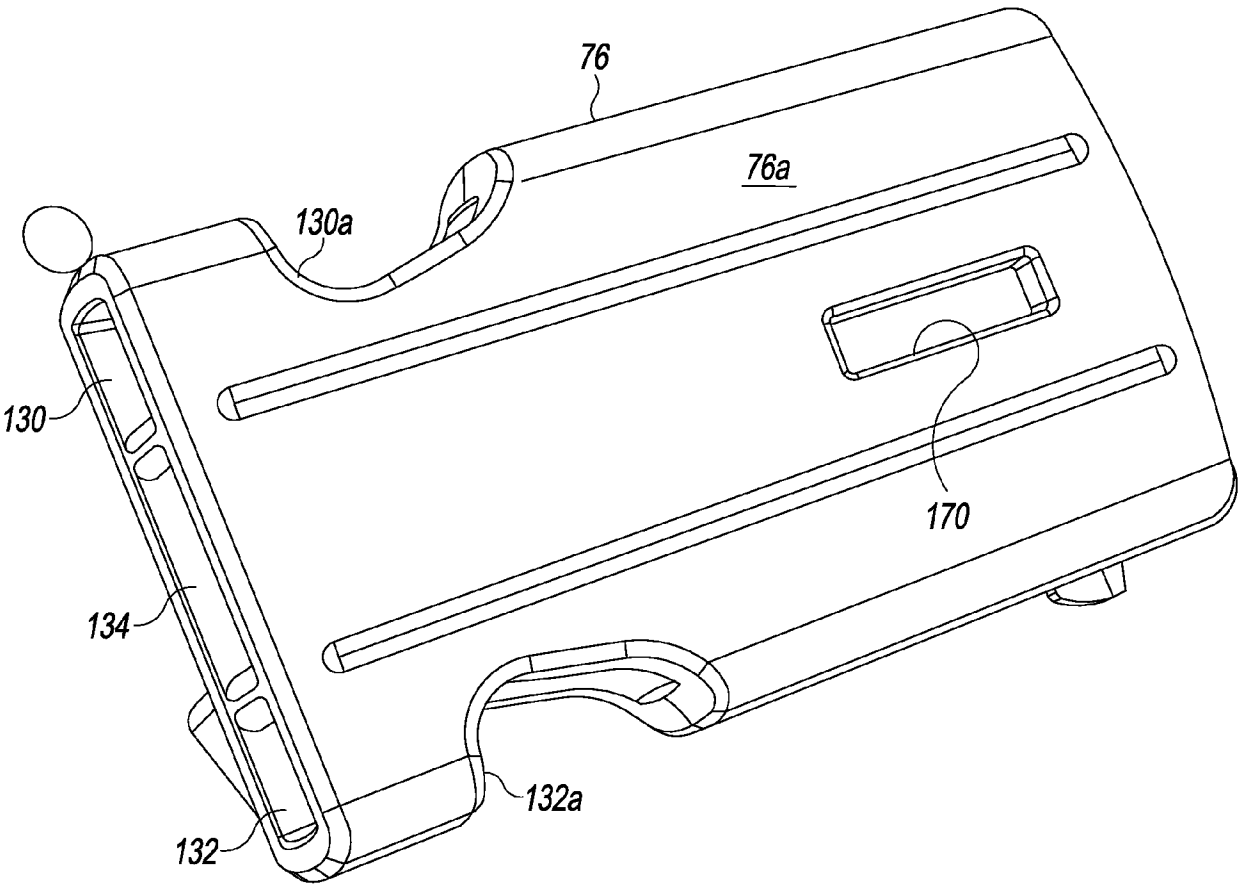
FIG. 17 is a right side perspective view of a latch-receiving casing taken from FIG. 14.

FIGS. 15-16A illustrate that the slider 160 includes a lug 162 having a slanted front surface 162*a* and an upstanding back surface 162*b*. The lug 162 is fit within an elongated slot 170 formed into the front face 76*a* of the casing 76 as shown in FIG. 17. The slanted front surface 162*a* allows the slider 160 to be wedged away from the spring 146 during initial assembly of the lock 78 onto the casing 76, until the lug snaps into the slot 170; the spring 146 and prongs 130, 132 being inside the casing and the slider being outside the casing 76. The lug 146*a* is also shown as having a front slanted surface 146*b*. This allows for the wedging of the casing open sufficiently for the lug 146*a* to snap into the slot 147 in the back wall 76*b* of the casing 76 as shown in FIG. 18.

Figure 18:
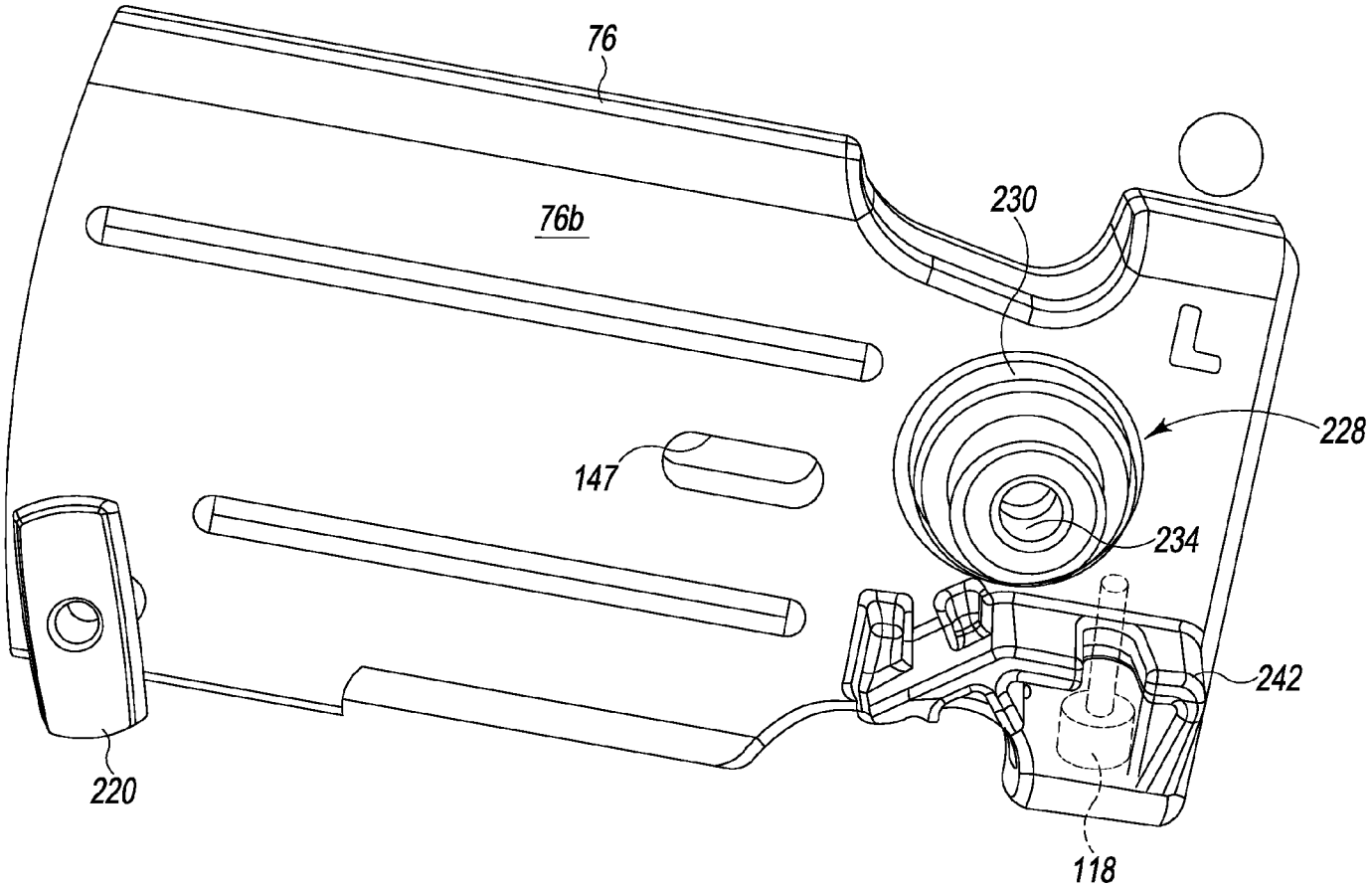
FIG. 18 is a left side perspective view of the latch-receiving casing taken from FIG. 17.

FIG. 18 illustrates a rear side of the casing 76. The rear side includes the back wall 76*b* and a sliding lug 220 protruding therefrom. A raised boss 228 provides a circumferential shoulder 230 which is wrapped by the elastic cord 114 (FIG. 5) and a threaded bore 234 for engagement by a screw 236 (FIG. 6) to pivotally attach the link 110 to the casing 76. Also, an anchor seat 242 is provided for receiving the anchor 118 of the elastic cord (a portion of the cord is shown dashed).

Figure 19:
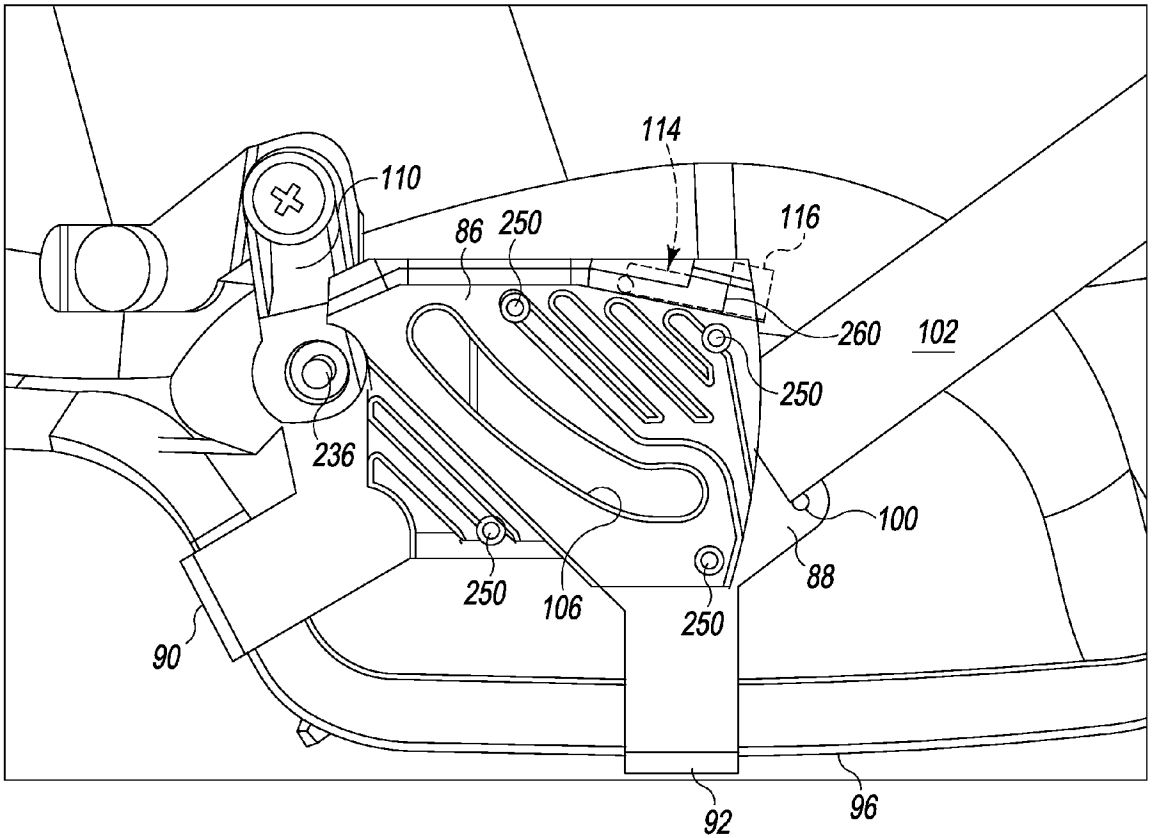
FIG. 19 is a fragmentary side view of the visor connection portion taken from FIG. 11 with portions removed to view underlying elements.
Figure 20:
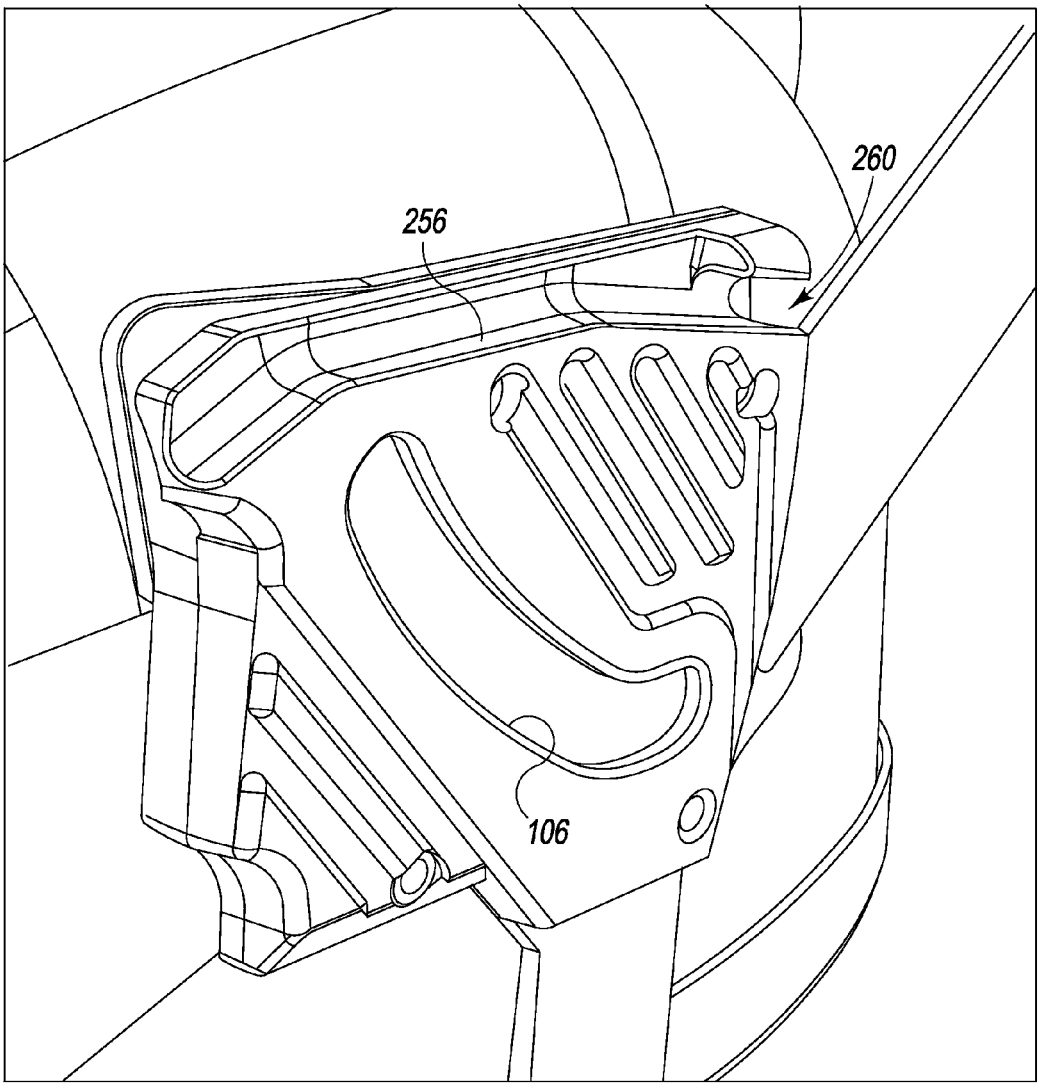
FIG. 20 is a right side perspective view of the visor connection portion of FIG. 19 with portions removed to view underlying elements.

FIGS. 19 and 20 illustrate the guide plate 86 mounted on the bracket 88 by screws 250. The casing 76 is removed in this view. The guide plate 86 provides an elastic cord guide surface or contoured support 256 along its length. At one end of the support 256 is an anchor seat 260 that receives and retains the head 116 of the elastic cord (a portion of the cord is shown dashed in FIGS. 19 and 21).

Figure 21:
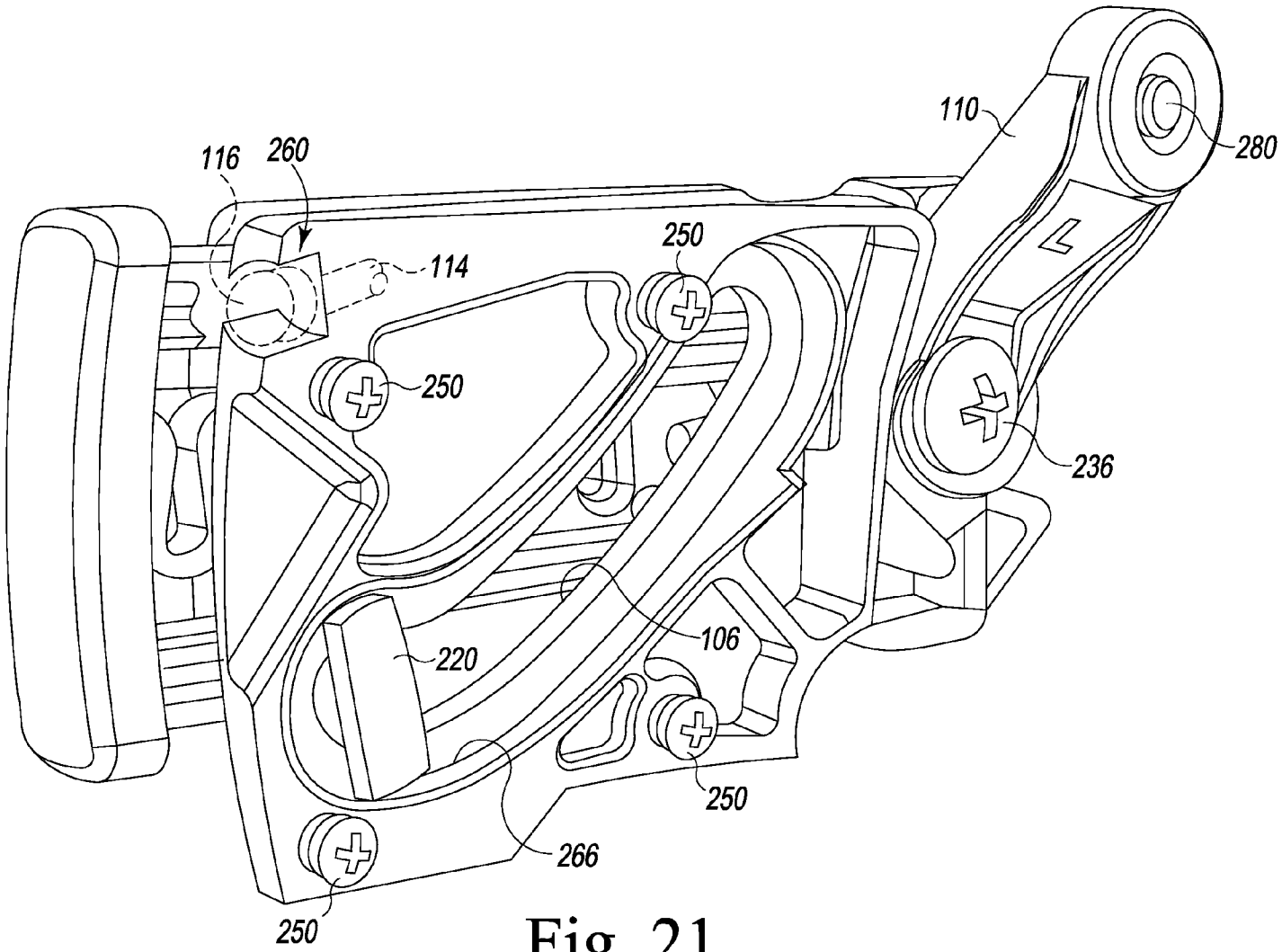
FIG. 21 is a left side perspective view of the visor connection portion of FIG. 11 with portions removed to view underlying elements.

FIG. 21 illustrates the sliding lug 220 fits within a curved raceway 266 and retains the casing 64 onto the guide plate 86 by being too large to be retracted through the slot 106 while allowing a neck portion 270 (FIG. 26) to fit in and slide along the slot 106.

Figure 22:
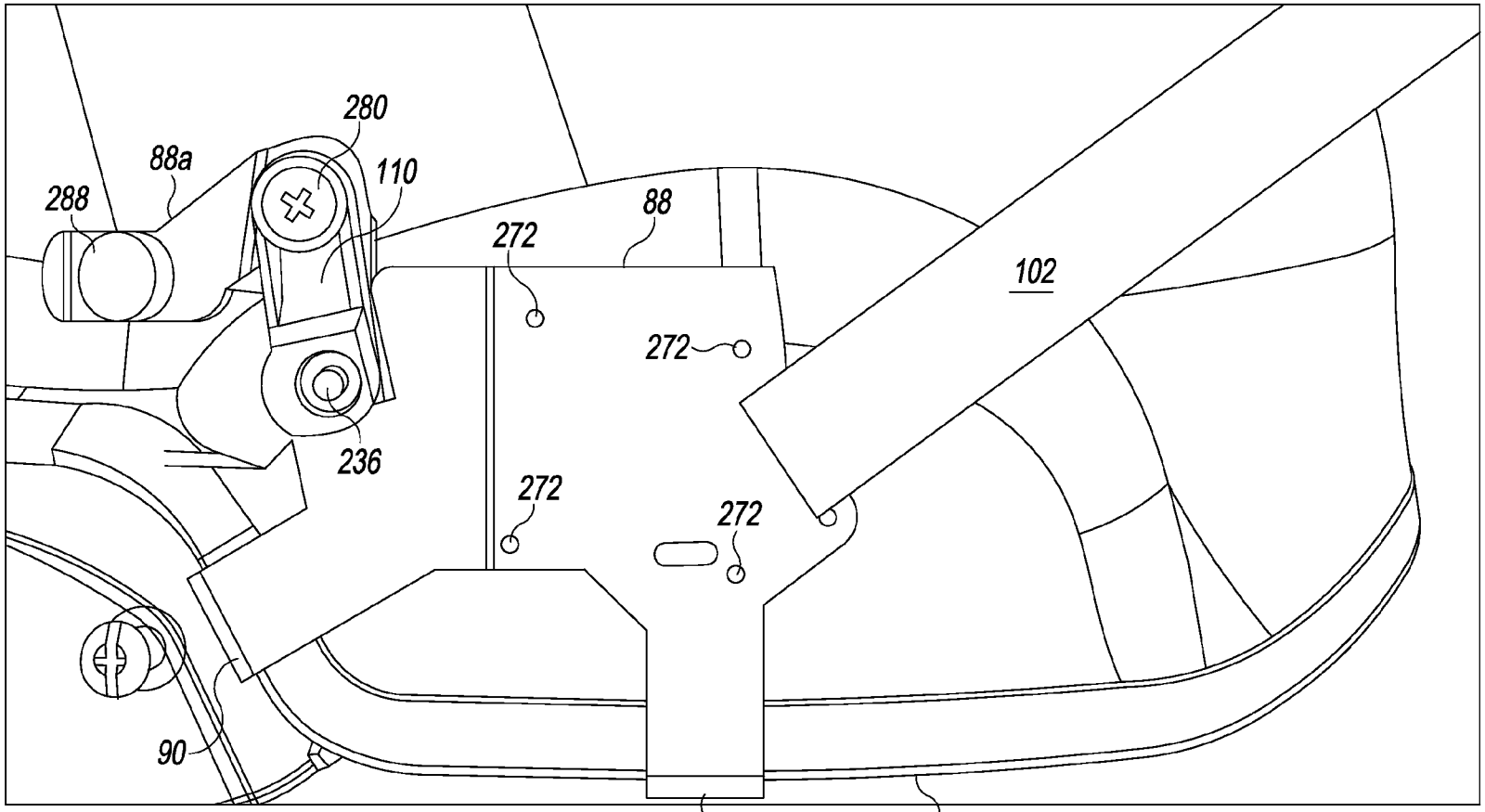
FIG. 22 is a side view of the visor connection portion of FIG. 11 with portions removed to view underlying elements.

FIG. 22 illustrates the bracket 88 having plain holes 272 for receiving the screws 250 (see FIG. 21) for attaching the bracket 88 to the guide plate 86. Also, a screw 280 is provided for pivotally attaching the lever 110 to the bracket 88. The bracket includes a frontal finger portion 88*a* that includes a slot 88*b* (FIG. 2) for receiving a finger screw 288 for attachment to the helmet.

FIGS. 23-28 illustrate an alternate embodiment latch and lock in accordance with FIGS. 9 and 10. This embodiment is identical to the embodiment shown in FIGS. 1-8 and 11-22 except as described below.

In the embodiment of FIGS. 23-28, the lock is not spring biased into the lock position. The lock 78' includes a retaining plug 300 that allows a range of sliding movement between the lock 78' and a modified casing 76', between the unlocked position of FIG. 23 and the locked position of FIG. 24. A locking arm 306 is formed in parallel with the retaining plug 300.

Figure 23:
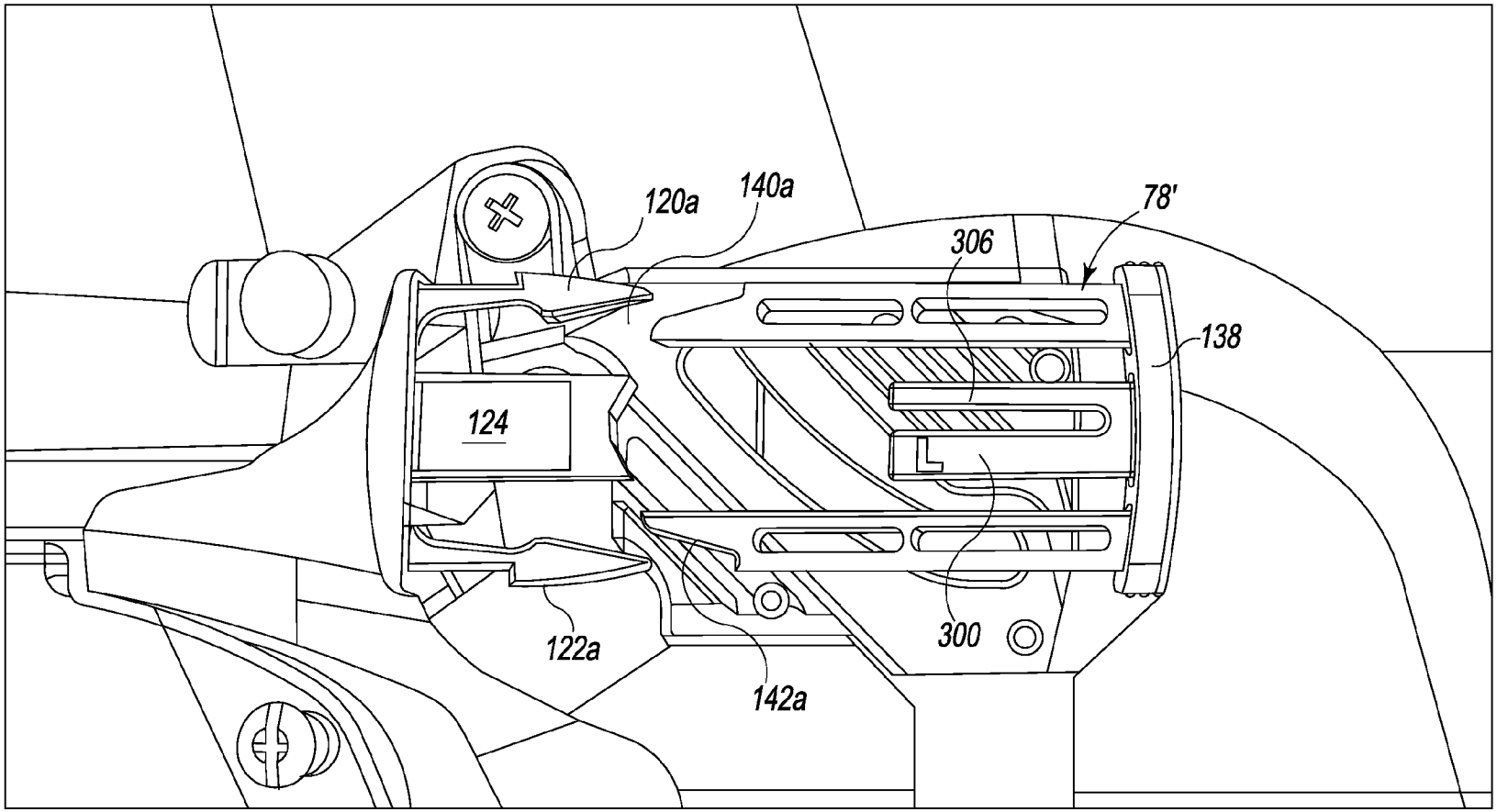
FIG. 23 is a side view of an alternate embodiment visor connection portion with portions removed to view underlying elements, the connection portion shown in a latched but unlocked condition.
Figure 24:
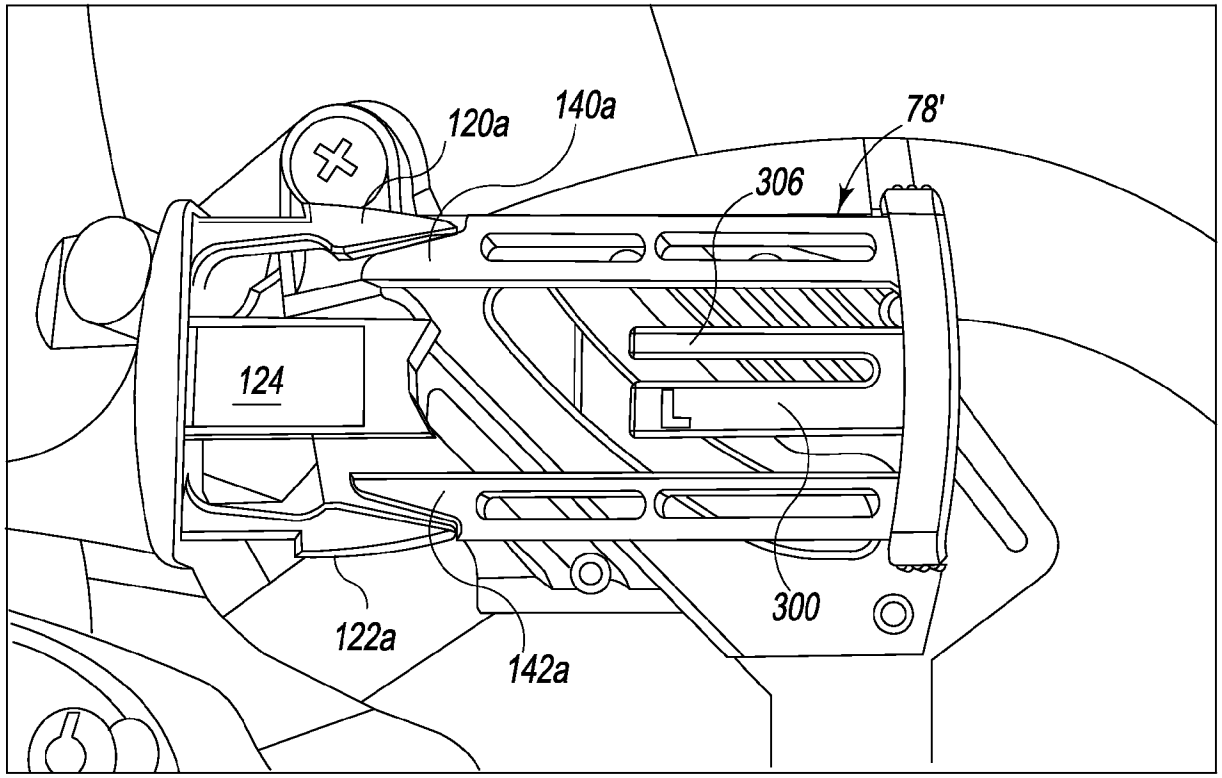
FIG. 24 is a side view of the alternate embodiment visor connection portion of FIG. 23 with portions removed to view underlying elements, the connection portion shown in a latched and locked condition.
Figure 25:
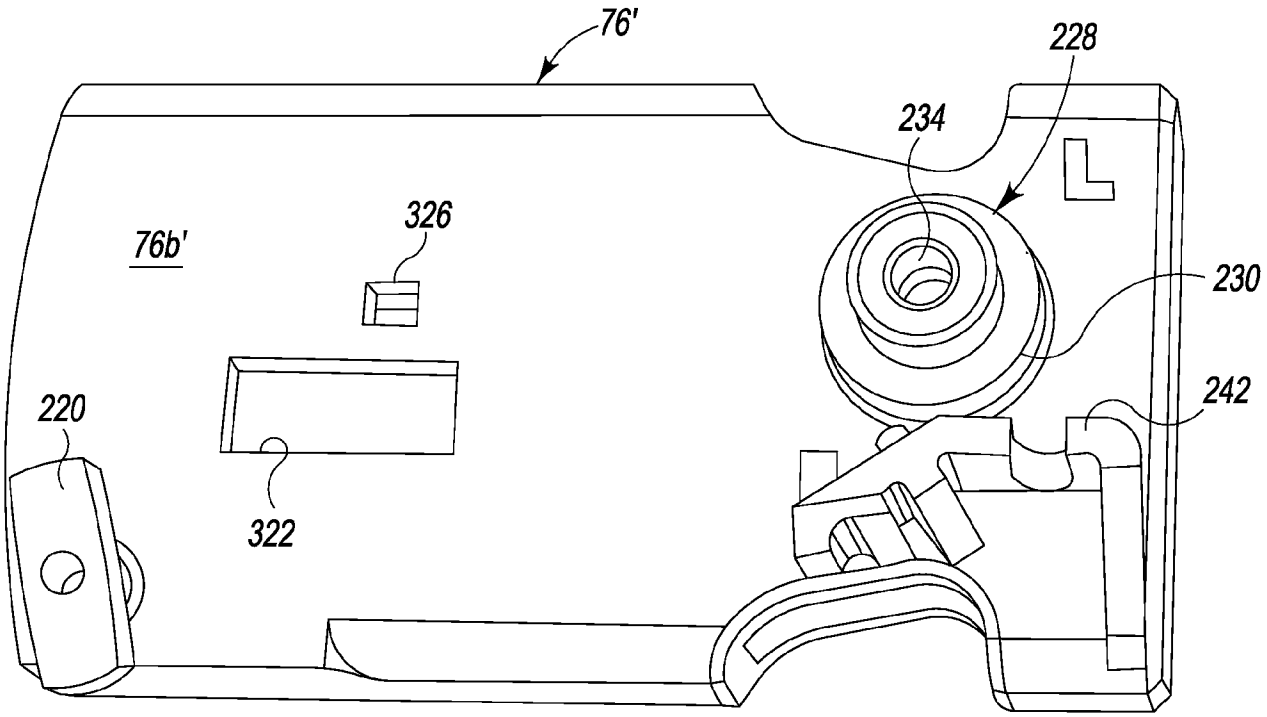
FIG. 25 is a right side perspective view of an alternate latch receiving casing to receive the lock element shown in FIG. 24.
Figure 26:
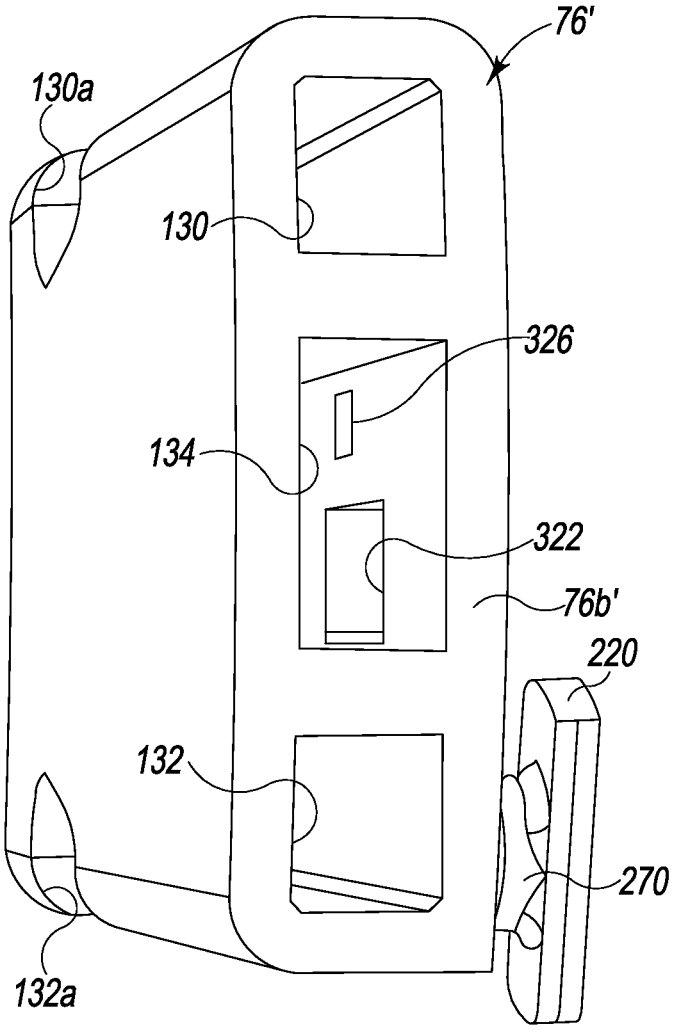
FIG. 26 is a rear perspective view of the casing of FIG. 25.
Figure 27:
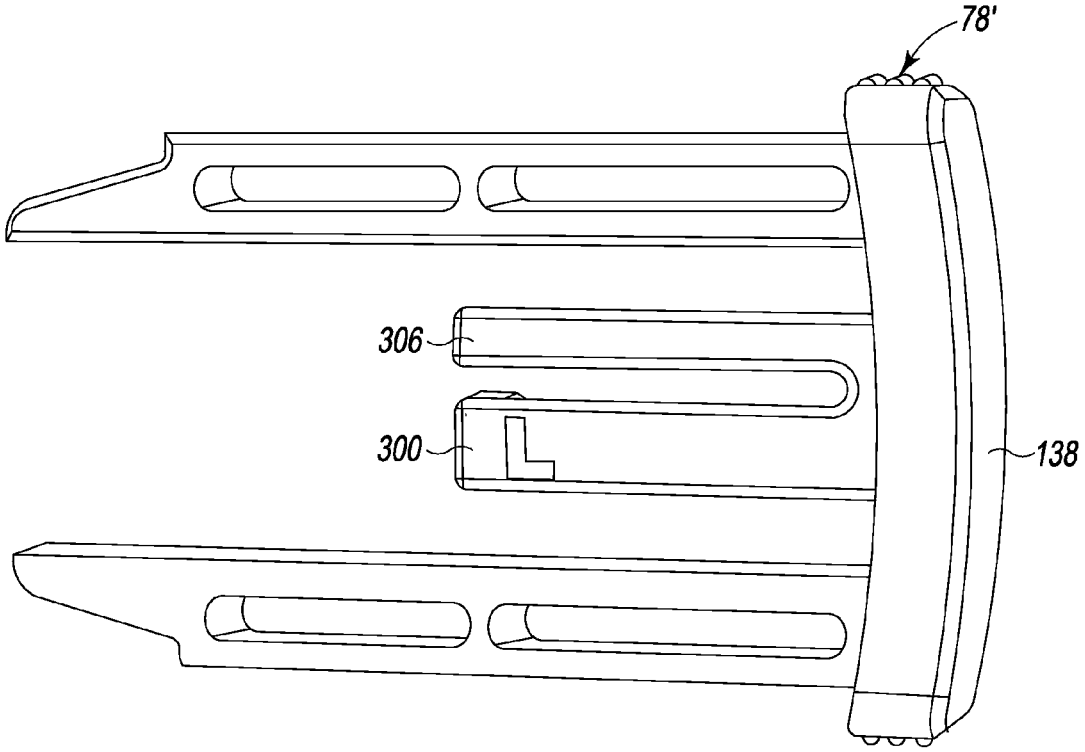
FIG. 27 is a rear perspective view of the lock element shown in FIG. 25.
Figure 28:
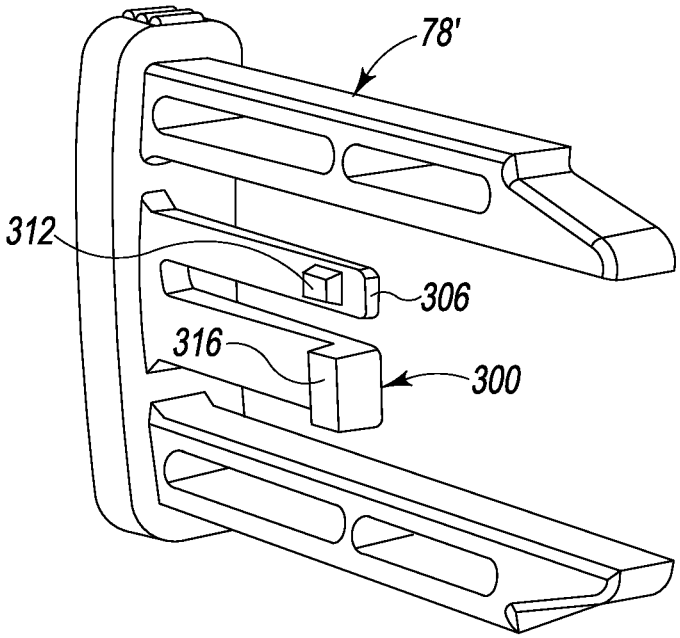
FIG. 28 is a front perspective view of the lock element of FIG. 27.
Figure 29:
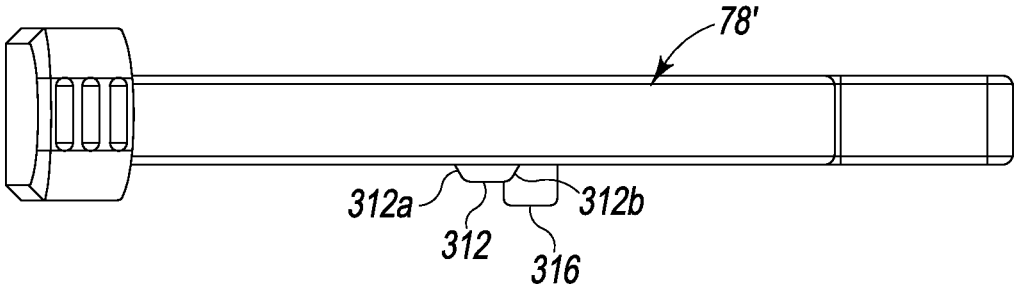
FIG. 29 is a top view of the lock element shown in FIG. 28.

As shown in FIG. 28, the locking arm 306 includes a protrusion or detent 312 and the retaining plug 300 includes a lug 316. When the lock 78' is engaged into the casing 76', the lug 316 fits into a slot 322 formed into a back wall 76*b'* of the casing 76'. The length of the slot permits sliding of the lock 78' between the locked and unlocked positions. When the lock 78' is slid to the locked position, the protrusion 312 on the locking arm 306 snaps into a locking aperture 326 also formed into the back wall 76*b'* of the casing 76'. As shown in FIG. 29, the protrusion 312 includes a rear slanted face 312*a* and a front slanted face 312*b*. To slide the lock from the locked position to the unlocked position, the lock 78' is pulled rearward with sufficient force that sliding of the rear slanted face 312*a* against a rear edge of the aperture assists in lifting the protrusion 312 out of the aperture 326 to allow the lock 78' to be retracted to the unlocked position (FIG. 23).

From the foregoing, it will be observed that numerous variations and modifications may be effected without departing from the spirit and scope of the invention. It is to be understood that no limitation with respect to the specific apparatus illustrated herein is intended or should be inferred.

All references, including publications, patent applications, and patents, cited herein are hereby incorporated by reference to the extent that the references are not inconsistent with the present disclosure and to the same extent as if each reference were individually and specifically indicated to be incorporated by reference and were set forth in its entirety herein.

The invention claimed is:

1. An assembly for mounting a visor on a helmet comprising:

a visor assembly having a lens and a fastening element with at least one latching prong with a resiliently displaceable prong end;

a casing attached to the helmet and having at least one channel for receiving the at least one latching prong and at least one fixture, each fixture for engaging a respective prong end when displaced outwardly;

a lock having at least one locking prong that is insertable into the channel from an opposite end as the at least one latching prong and which has a locking prong end that is positionable under a respective latching prong to prevent displacement of the prong end inwardly to disengage from the respective fixture.

2. The assembly according to claim 1, wherein the casing is pivotally and slidably attached to the helmet.

3. The assembly according to claim 1, wherein the lock is spring biased in the casing to the locked position.

4. The assembly according to claim 1, wherein the lock includes a locking detent that is releasably engaged to the casing to hold the lock in the locked position.

5. The assembly according to claim 1, wherein the casing is mounted on a mounting assembly having an arcuate guide slot, the casing having a lug that rides in the guide slot as the visor is pivoted from a deployed position to a tilted up position.

6. The assembly according to claim 5, wherein the casing is pivotally fastened to a lever that is pivotally fastened to the mounting assembly.

7. The assembly according to claim 6, wherein the mounting assembly comprises a bracket having hooks that engage a brim of the helmet, a strap that attaches to the bracket, and a guide plate fastened to the bracket, the guide plate providing the arcuate guide slot; and an elastic cord fixed to the guide plate at one end and to the casing at an opposite end, the elastic cord channeled along a top of the guide plate.

8. The assembly according to claim 7, further comprising a pivotal fastening between the helmet and the bracket.

9. The assembly according to claim 1, wherein the at least one latching prong comprises a pair of latching prongs and the at least one fixture in the casing comprises edge portions of the casing that define opposite side windows, and wherein the latching prongs are deflected inwardly to enter the at least one channel and when fully inserted spring outwardly such that the latching prong ends enter the windows with the edges preventing separation of the fastening element from the casing, and wherein the locking prongs are inserted into the locked position underlying the respective latching prongs in the parallel channels, preventing inward movement of the latching prongs.

10. An assembly for mounting a visor on a helmet comprising:

a visor assembly having a lens and a fastening element in part supporting the lens and having a latching element;

a receiving element attached to the helmet and having a structure for receiving the latching element and an engagement element for engaging the latching element, at least one of the latching element and the engagement element being resiliently displaceable to disengage the latching element from the engagement element;

a lock having a locking element that is engageable with one of the fastening element or the receiving element and which has a locking portion that is positionable adjacent to the at least one of the latching element and the engagement element to prevent disengagement of the latching element from the engagement element.

11. The assembly according to claim 10, wherein the structure is pivotally and slidably attached to the helmet.

12. The assembly according to claim 10, wherein the lock is spring biased to the structure to the locked position.

13. The assembly according to claim 10, wherein the lock includes a locking detent that is releasably engaged to the structure to hold the lock in the locked position.

14. The assembly according to claim 10, wherein the structure is mounted on a mounting assembly having an arcuate guide slot, the structure having a lug that rides in the guide slot as the visor is pivoted from a deployed position to a tilted up position.

15. The assembly according to claim 14, wherein the structure is pivotally fastened to a lever that is pivotally fastened to the mounting assembly.

16. The assembly according to claim 15, wherein the mounting assembly comprises a bracket having hooks that engage a brim of the helmet, a strap that attaches to the bracket, and a guide plate fastened to the bracket, the guide plate providing the arcuate guide slot; and an elastic cord fixed to the guide plate at one end and to the structure at an opposite end, the elastic cord channeled along a top of the guide plate.

17. The assembly according to claim 16, further comprising a pivotal fastening between the helmet and the bracket.

18. The assembly according to claim 10, wherein the latching element comprises a pair of latching prongs and the engagement element of the structure comprises edge portions of the structure that define opposite side windows, and wherein the latching prongs are deflected inwardly to enter the structure and when fully inserted spring outwardly such that the latching prong ends enter the windows with the edges preventing separation of the fastening element from the structure, and wherein the locking portion comprises a pair of locking prongs that are positioned underlying the respective latching prongs in the parallel channels when in the locked position, preventing inward movement of the latching prongs.

* * * * *